US006056087A

United States Patent [19]

Addy et al.

[11] Patent Number: 6,056,087

[45] Date of Patent: May 2, 2000

[54] METHOD AND APPARATUS FOR PROVIDING SECURITY TO A SELF-SERVICE CHECKOUT TERMINAL

[75] Inventors: John C. Addy, Lawrenceville; James Morrison, Suwanee, both of Ga.

[73] Assignee: NCR Corporation, Dayton, Ohio

[21] Appl. No.: 08/939,868

[22] Filed: Sep. 29, 1997

[51] Int. Cl.[7] ..... A47F 9/04

[52] U.S. Cl. ..... 186/61; 16/66; 235/383

[58] Field of Search ..... 186/61, 66; 235/383

[56] References Cited

U.S. PATENT DOCUMENTS

| | | | |
|---|---|---|---|
| 3,436,968 | 4/1969 | Unger et al. | 73/433 |
| 3,681,571 | 8/1972 | Strohschneider | 235/61.7 R |
| 3,836,755 | 9/1974 | Ehrat | 235/61.7 R |
| 4,071,740 | 1/1978 | Gogulski | 186/61 X |
| 4,138,000 | 2/1979 | Hartup | 186/61 |
| 4,676,343 | 6/1987 | Humble et al. | 186/61 |
| 4,964,053 | 10/1990 | Humble | 364/466 |
| 5,083,638 | 1/1992 | Schneider | 186/61 |
| 5,115,888 | 5/1992 | Schneider | 186/61 |
| 5,174,413 | 12/1992 | Cappi et al. | 186/66 |
| 5,195,613 | 3/1993 | Kohno | 186/59 |
| 5,239,167 | 8/1993 | Kipp | 235/383 |
| 5,437,346 | 8/1995 | Dumont | 186/61 |
| 5,488,202 | 1/1996 | Baitz et al. | 177/25.15 |
| 5,494,136 | 2/1996 | Humble | 186/61 |
| 5,540,301 | 7/1996 | Dumont | 186/61 |
| 5,543,607 | 8/1996 | Watanabe et al. | 235/383 |

*Primary Examiner*—F. J. Bartuska
*Attorney, Agent, or Firm*—Maginot, Addison & Moore

[57] ABSTRACT

A method of providing security to a self-service checkout terminal having a bagwell and a light curtain device that generates a light curtain which is positioned over the bagwell includes the step of locating a grocery container in the bagwell. The method also includes the step of generating an item-entered control signal when a product code associated with an item is entered into the terminal. The method further includes the step of advancing the item through the light curtain and into the grocery container and generating a first detection control signal in response thereto. Moreover, the method includes the step of generating an invalid-use control signal when the first detection control signal is generated prior to generation of the item-entered control signal. A self-service checkout terminal is also disclosed.

23 Claims, 23 Drawing Sheets

| FIG. 5A | FIG. 5B | FIG. 5C |
|---|---|---|

| | | |
|---|---|---|
| FIG. 10A | FIG. 10B | FIG. 10C |
| FIG. 10D | FIG. 10E | FIG. 10F |

METHOD AND APPARATUS FOR PROVIDING SECURITY TO A SELF-SERVICE CHECKOUT TERMINAL

CROSS REFERENCE

Cross reference is made to copending U.S. patent application Ser. No. 09/019,880, pending 2876 entitled "Method and Apparatus for Enhancing security in a Self-Service Checkout Terminal" by John Addy and Marc Lynn which is assigned to the same assignee as the present invention, and which was filed on Feb. 6, 1998.

TECHNICAL FIELD OF THE INVENTION

The present invention relates generally to a checkout or point-of-sale (POS) terminal, and more particularly to a method and apparatus for providing security to a self-service checkout terminal.

BACKGROUND OF THE INVENTION

In the retail industry, the largest expenditures are typically the cost of the goods sold followed closely by the cost of labor expended. With particular regard to the retail grocery or supermarket industry, the impetus to reduce labor costs has focused on reducing or eliminating the amount of time required to handle and/or process the items or goods to be purchased by a user or customer. To this end, there have been a number of self-service checkout terminal concepts developed which attempt to substantially eliminate the need for a checkout clerk.

A self-service checkout terminal is a system which is operated by a customer without the aid of a checkout clerk. In such a system, the customer scans individual items for purchase across a scanner and then places the scanned item into a grocery bag, if desired. The customer then pays for his or her purchase either at the self-service checkout terminal if so equipped, or at a central payment area which is staffed by a store employee. Thus, a self-service checkout terminal permits a customer to select, itemize, and in some cases pay for his or her purchase without the assistance of the retailer's personnel.

A customer typically has little or no training in the operation of a self-service checkout terminal prior to his or her initial use of the checkout terminal. One concern that retailers have when evaluating a self-service checkout terminal is the level of supervision provided to inexperienced customers.

It is also known that some customers may have improper intentions when using a self-service checkout terminal. In traditional checkout systems, the clerk employed by the retailer to operate the checkout terminal provides a level of security against theft or other improprieties. However, in the case of a self-service checkout terminal, the terminal itself must provide the necessary supervision and security. Such supervision and security includes preventing a customer from either inadvertently or intentionally placing an item in a grocery bag without scanning the item, or scanning one item, but placing a second item of greater value in the bag. Thus, another concern when evaluating a self-service checkout terminal is the level of security provided against illicit use of the self-service checkout terminal by customers.

What is needed therefore is a self-service checkout terminal which assists or otherwise supervises a customer in the use thereof. What is further needed is a self-checkout terminal which provides security from theft and other improprieties.

SUMMARY OF THE INVENTION

According to a first embodiment of the present invention, there is provided a method of providing security to a self-service checkout terminal. The method includes the step of generating an item-entered control signal when a product code associated with an item is entered into the terminal. The method also includes the step of detecting insertion of the item into a grocery container with a light curtain device and generating a first detection control signal in response thereto. The method further includes the step of generating an invalid-use control signal when the first detection control signal is generated prior to generation of the item-entered control signal.

According to a second embodiment of the present invention, there is provided a self-service checkout terminal. The terminal includes a bagwell for holding a grocery container. The bagwell defines an opening through which an item may be advanced. The terminal also includes a light curtain device which (1) generates a light curtain positioned to cover the opening of said bagwell, and (2) generates a first detection control signal when the item is advanced through the light curtain and into the bagwell.

According to a third embodiment of the present invention, there is provided a method of providing security to a self-service checkout terminal having a bagwell and a light curtain device that generates a light curtain which is positioned over the bagwell. The method includes the step of locating a grocery container in the bagwell. The method also includes the step of generating an item-entered control signal when a product code associated with an item is entered into the terminal. The method further includes the step of advancing the item through the light curtain and into the grocery container and generating a first detection control signal in response thereto. Moreover, the method includes the step of generating an invalid-use control signal when the first detection control signal is generated prior to generation of the item-entered control signal.

It is therefore an object of the present invention to provide a new and useful self-service checkout terminal.

It is another object of the present invention to provide an improved self-service checkout terminal.

It is moreover an object of the present invention to provide a new and useful method of providing security to a self-service checkout terminal.

It is a further object of the present invention to provide an improved method of providing security to a self-service checkout terminal.

It is yet another an object of the present invention to provide a method and apparatus for assisting or otherwise supervising a customer in the use and operation of a self-service checkout terminal.

It is moreover an object of the present invention to provide a method and apparatus which provide a self-service checkout terminal with enhanced security from theft and other improprieties.

The above and other objects, features, and advantages of the present invention will become apparent from the following description and the attached drawings.

DETAILED DESCRIPTION OF THE INVENTION

Figure 1:
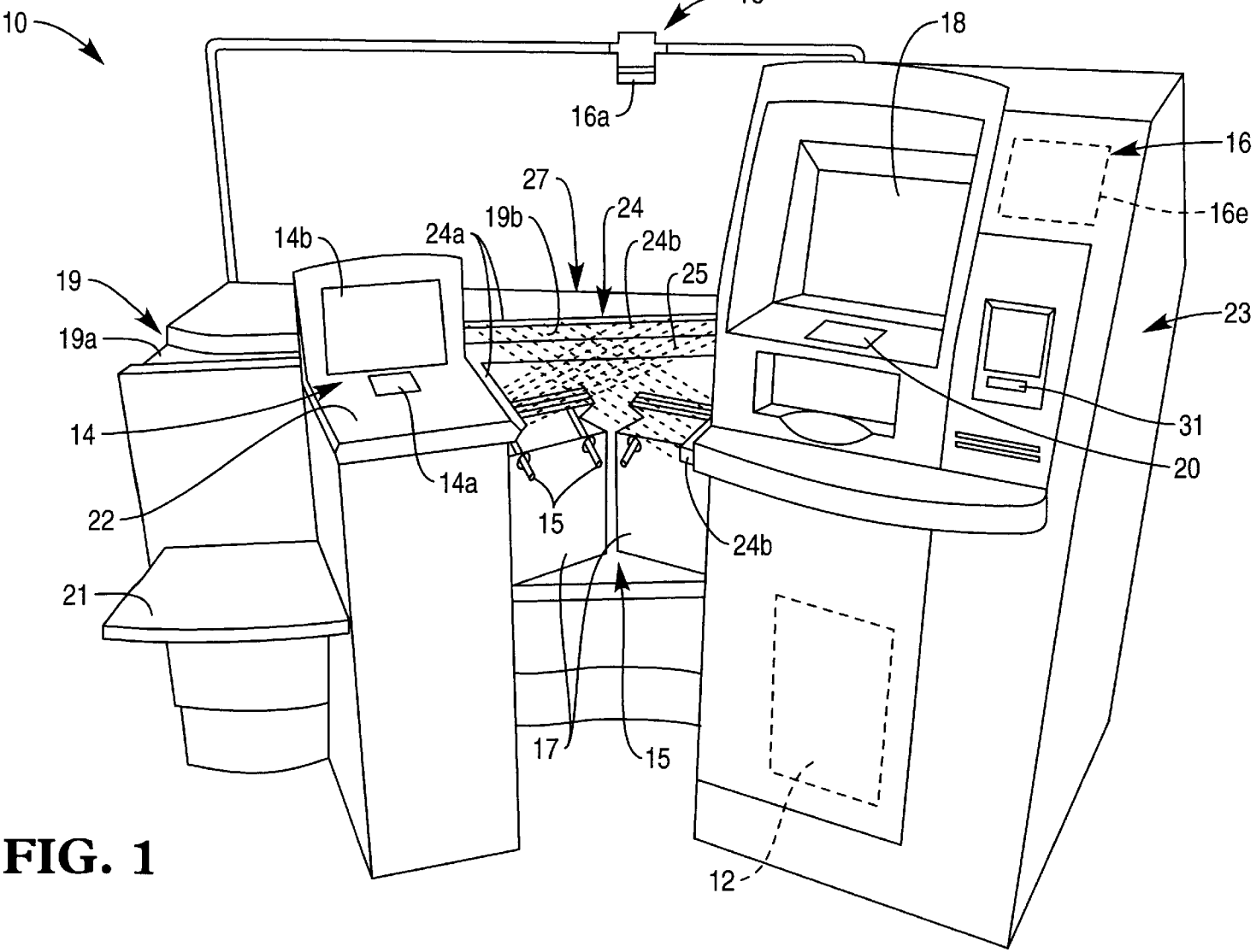
FIG. 1 is a perspective view of a self-service checkout terminal which incorporates the features of the present invention therein.

While the invention is susceptible to various modifications and alternative forms, specific embodiments thereof have been shown by way of example in the drawings and will herein be described in detail. It should be understood, however, that there is no intent to limit the invention to the particular forms disclosed, but on the contrary, the intention is to cover all modifications, equivalents, and alternatives falling within the spirit and scope of the invention as defined by the appended claims.

Figure 2:
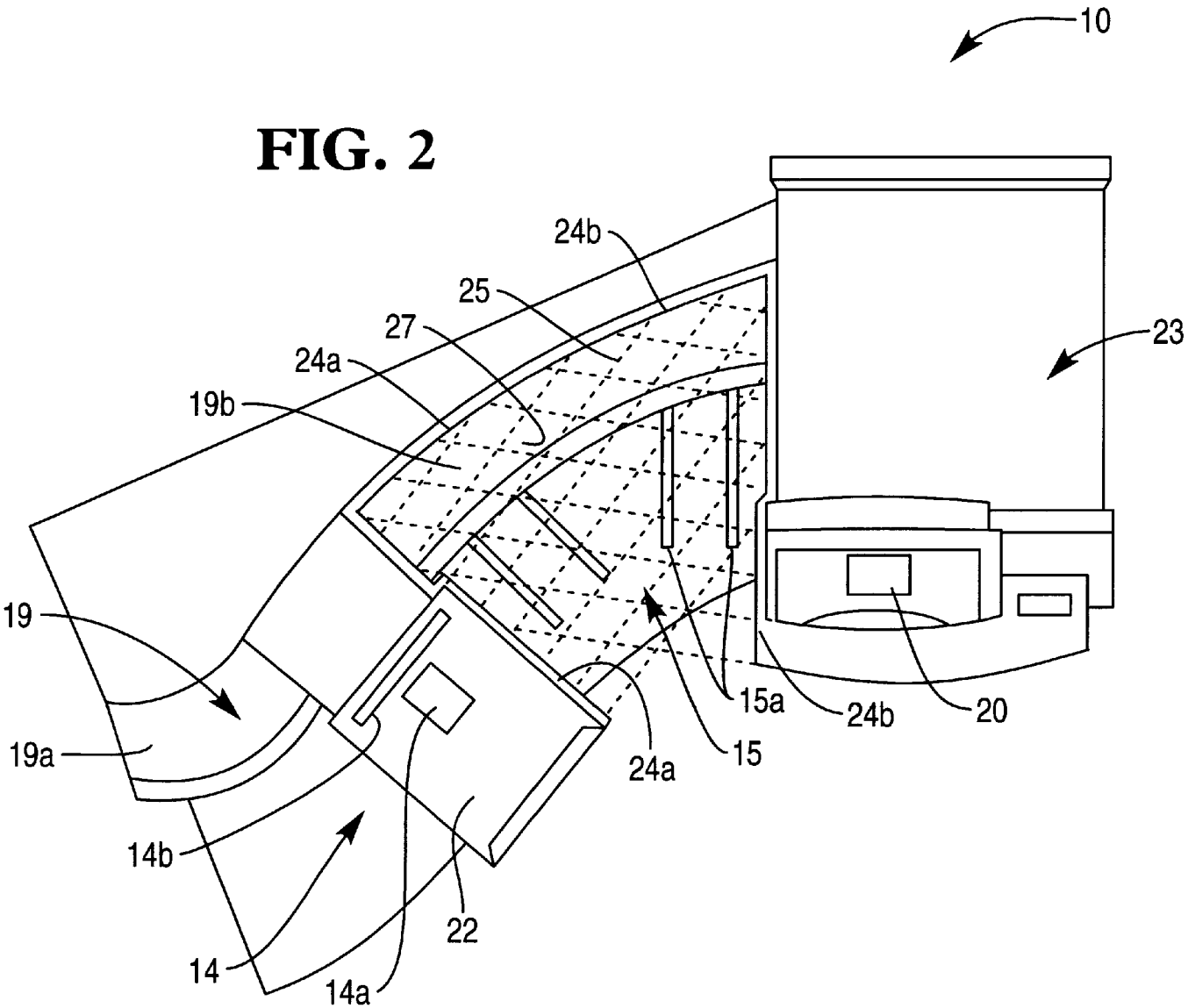
FIG. 2 is a top elevational view of the self-service checkout terminal of FIG. 1 (Note: the video camera 16*a* and the grocery bags 17 have been removed for clarity of description)

Referring now to FIGS. 1 and 2, there is shown a self-service checkout terminal 10 for use in a retail business such as a grocery store. The self-service checkout terminal 10 includes a processing unit 12, a code entry device or scanner 14, a video system 16, a display monitor 18, a code entry or data input device 20, a product scale 22, and a light curtain device 24. The self-service checkout terminal 10 also includes a bagwell 15 for accommodating one or more grocery bags 17, a counter 19, and a basket shelf 21. The display monitor 18, the data input device 20, and a number of the components associated with the video system 16 may be embodied as separate devices, or they may be preferably embodied as integrated components associated with an automated teller machine (ATM) 23. For example, a video camera 16*a* of the video system 16 may be embodied as a separate component (see FIG. 1), or may be alternatively embodied as a component integrated into the ATM 23 (see FIG. 3).

The scanner 14 conventionally scans or reads a product identification code such as a Universal Product Code (UPC), industrial symbol(s), alphanumeric character(s), or other indicia associated with an item to be purchased. One scanner which may be used in the present invention is a model number 7875 bi-optic scanner which is commercially available from NCR Corporation of Dayton, Ohio.

The scanner 14 includes a first scanning window 14*a* and a second scanning window 14*b*. The first scanning window 14*a* is disposed in a substantially horizontal manner, whereas the second scanning window 14*b* is disposed in a substantially vertical manner, as shown in FIG. 1. The product scale 22 is integrated with the scanner 14. More specifically, the product scale 22 is disposed substantially parallel to the scanning window 14*a* thereby enveloping the scanning window 14*a*. If an item such as produce is placed upon the product scale 22 or the first scanning window 14*a*, the product scale 22 may be used to determine the weight of the item.

The scanner 14 also includes a light source (not shown) such as a laser, a rotating mirror (not shown) driven by a motor (not shown), and a mirror array (not shown). In operation, a laser beam reflects off the rotating mirror and mirror array to produce a pattern of scanning light beams. As the product identification code on an item is passed over the scanner 14, the scanning light beams scatter off the code and are returned to the scanner 14 where they are collected and detected. The reflected light is then analyzed electronically in order to determine whether the reflected light contains a valid product identification code pattern. If a valid code pattern is present, the product identification code is then converted into pricing information which is then be used to determine the cost of the item in a known manner.

A video camera 16*a* of the video system 16 is disposed above the counters 19 and is positioned for detecting motion within a number of "target areas" associated with the video system 16. What is meant herein by use of the term "target area" of the video system 16 is an area across which the video system 16 is capable of detecting motion. For example, a first target area is defined by the maximum range in which an item can be successfully scanned as it is passed across the scanner 14. A second target area is defined by an area proximate the ATM 23. Motion proximate the ATM 23 is indicative of a user or customer attempting to use a component of the ATM 23 such as the data input device 20.

The display monitor 18 displays instructions which serve to guide a customer through a checkout procedure. For example, an instruction is displayed on the display monitor 18 which instructs the customer to remove an item from a grocery cart or trolley (not shown) and pass the item over the scanner 14. If the scanner 14 successfully scans or reads the product identification code associated with the item, then a visual indication is generated on the display monitor 18. If for any reason the scanner 14 cannot read or otherwise determine the product identification code associated with the item, a visual error message is generated on the display monitor 18. Moreover, the display monitor 18 may be a known touch screen monitor which can generate data signals when certain areas of the screen are touched by a user. In addition to, or in lieu of the display monitor 18, a device for generating audio or voice instructions may also be included. For example, a voice generating device (not shown) may be used to inform the customer of the type and cost of each item scanned thereby reducing the number of occasions in which the customer must look at the display monitor 18 during operation of the self-service checkout terminal 10.

The counter 19 defines an arcuate surface as shown in FIG. 2. What is meant herein by the term "arcuate surface" is a surface which possess a curved or bowed shape. Such an arcuate surface allows the counter 19 to be positioned relatively close to both the scanner 14 and the bagwell 15 thereby permitting the counter 19 to function as a "set-aside surface" for use by the customer during operation of the self-service checkout terminal 10. What is meant herein by the term "set-aside surface" is a surface on which items may be temporarily placed prior to either being (1) scanned or otherwise entered, or (2) loaded into one of the grocery bags 17 in the bagwell 15 if the item has already been scanned or otherwise entered.

Such set-aside surfaces are necessary to allow the customer to selectively choose the order in which items are scanned or otherwise entered. Moreover, such set-aside surfaces are necessary to allow a customer to selectively choose the order in which items are loaded into the grocery bags 17. For example, if the customer scanned a loaf of bread, the customer may wait to load the bread into the grocery bag 17 until the bag is nearly full thereby preventing the bread from being crushed. As alluded to above, it may be desirable to use the set-aside surfaces both before and after an item has been scanned or otherwise entered. Hence, as shown in FIG. 2, the scanner 14 divides the counter 19 into a pre-scan set-aside surface 19*a*, and a post-scan set-aside surface 19*b*. In particular, the scanner 14 divides the counter 19 into the pre-scan set-aside surface 19*a* which is upstream of the scanner 14, and the post-scan set-aside surface 19*b* which is downstream from the scanner 14. The terms 'upstream' and "downstream" are used to be consistent with the flow of items through the self-service checkout terminal 10 during a typical checkout procedure. In particular, an item enters at the area proximate the pre-scan set-aside surface 19*a* then flows in a downstream direction to be scanned at the scanner 14 so as to enter a product code associated with the item. Once the product code associated with the item is entered, the item flows from the scanner 14 in a downstream direction to the post-scan set-aside surface 19*b* or the bagwell 15.

The bagwell 15 is disposed between the scanner 14 and the ATM 23 as shown in FIG. 1. The bagwell 15 includes a number of posts 15*a* which cooperate to support a number of the grocery bags 17. The bagwell 15 is configured to allow two or more grocery bags 17 to be accessed by the customer at any given time. In particular, the posts 15*a* are of a sufficient length to secure a number of unopened grocery bags 17 along with two or more opened grocery bags 17 thereby allowing a customer to selectively load various item types into the grocery bags 17. For example, the customer may desire to use a first grocery bag 17 for household chemical items such as soap or bleach, and a second grocery bag 17 for edible items such as meat and produce.

The light curtain device 24 is positioned around the periphery of the post-scan set-aside surface 19*b* and the bagwell 15. The light curtain device 24 is used for monitoring (1) the insertion of items into and the removal of items from the grocery bags 17, and (2) the positioning of items onto and the removal of items from the post-scan set-aside surface 19*b*.

The light curtain device 24 includes an emitter array 24*a* and a corresponding receiver array 24*b*. The emitter array 24*a* includes a light source, such as an array of light-emitting diodes, and is secured around a first section of the periphery of the post-scan set aside surface 19*b* and the bagwell 15. The receiver array 24*b* on the other hand, includes an array of photosensitive diodes, photocells, or similar devices, and is secured around a second section of the periphery of the post-scan set aside surface 19*b* and the bagwell 15. The emitter array 24*a* generates light or infrared rays or beams which are transmitted to the receiver array 24*b* thereby defining a "light curtain" 25, as shown in FIGS. 1 and 2. Collectively, the area covered by the light curtain 25 (i.e. the post-scan set-aside surface 19*b* and the bagwell 15) is hereinafter referred to as a post-scan area 27. It should therefore be appreciated that disruption of the light curtain 25 is indicative of (1) the insertion of items into or the removal of items from the grocery bags 17, or (2) the positioning of items on or the removal of items from the post-scan set-aside surface 19*b*. More specifically, disruption of the light curtain 25 is indicative of the insertion of items into or the removal of items from the post-scan area 27.

The basket shelf 21 is provided to allow a user of the self-service checkout terminal 10 to position a shopping basket or the like thereon in order to facilitate unloading of items for purchase. Alternatively, the basket shelf 21 may be retracted into a slot defined in a side panel (not shown) of the self-service checkout terminal 10 thereby allowing the user to position a shopping cart (not shown) adjacent the self-service checkout terminal 10 in order to facilitate the unloading of items from the cart during the checkout procedure.

Figure 3:
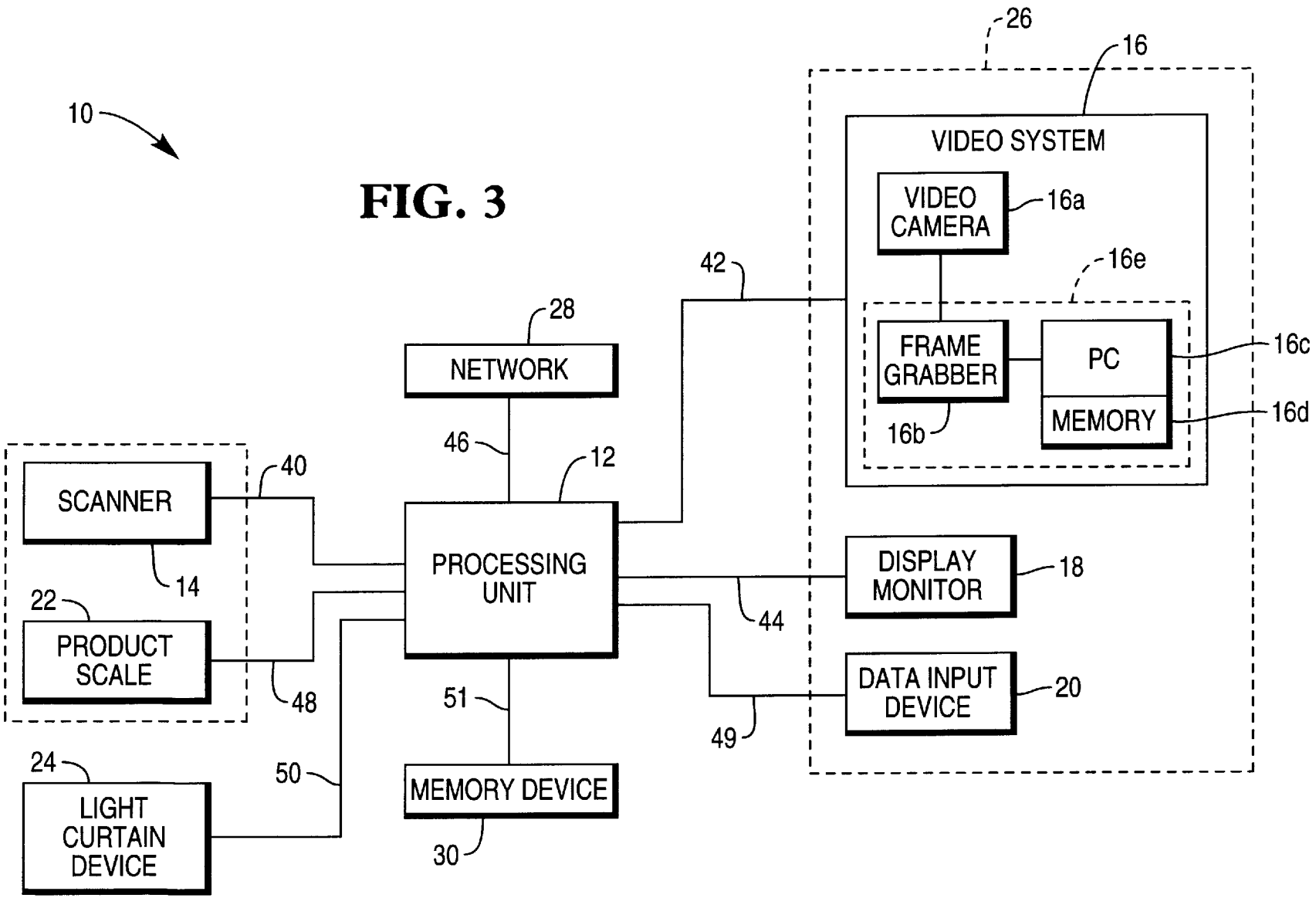
FIG. 3 is a simplified block diagram of the self-service checkout terminal of FIG. 1.

Referring now to FIG. 3, there is show a simplified block diagram of the self-service checkout terminal 10. The processing unit 12 is electrically coupled to the scanner 14, the video system 16, the display monitor 18, the data input device 20, the product scale 22, and the light curtain device 24. Moreover, the processing unit 12 is electrically coupled to a network 28 and a memory device 30, as shown in FIG. 3.

The processing unit 12 monitors output signals generated by the scanner 14, the video system 16, and the light curtain device 24 in order to supervise and provide security monitoring of a given checkout procedure. In particular, the processing unit 12 communicates with the scanner 14 via a data communication line 40. The scanner 14 generates an output signal on the data communication line 40 when a bar code associated with an item is successfully scanned or otherwise read by the scanner 14.

The processing unit 12 communicates with the video system 16 through a data communication line 42. The video system 16 includes the video camera 16*a*, a frame grabber 16*b*, and a processing system 16*c* such as a personal computer (PC). The PC 16*c* and the frame grabber 16*b* are collectively referred to a video processor 16*e*. The video processor 16*e* receives a standard video signal format, such as RS-170, NTSC, CCIR, or PAL, from the video camera 16*a*.

Video output signals from the video camera 16*a* are input to the frame grabber 16*b*. The frame grabber 16*b* operates to convert the analog video signals from the video camera 16*a* into a digital image which is stored within a memory 16*d* for subsequent processing by the video processor 16*e*. Once representations of the stream of digital images from the video camera 16*a* are sequentially stored in memory 16*d*, the video processor may begin to analyze or otherwise process the video image. One video system 16 which is suitable for use in the present invention is disclosed in U.S. Provisional Patent application Ser. No. 60/045,001 entitled "Motion Pattern Recognition for a Self Checkout System" which was filed on Feb. 7, 1997, by Ralph Crabtree, which is incorporated herein by reference, and which is assigned to the same assignee as the present invention.

The processing unit 12 communicates with the light curtain device 24 via data communication line 50. The light curtain device 24 generates an output signal on the data communication line 50 when the light curtain 25 generated thereby is interrupted by the insertion of items into or the removal of items from the post-scan area 27.

The processing unit 12 communicates with the display monitor 18 through a data communication line 44. The processing unit 12 generates output signals on the data communication line 44 which cause various instructional messages to be displayed on the display monitor 18. The display monitor 18 may include known touch screen technology which can generate output signals when the customer touches a particular area of the display screen associated with the display monitor 18. The signals generated by the display screen are transmitted to the processing unit 12 via the data communication line 44.

The processing unit 12 is coupled to the product scale 22 via a data communication line 48. The product scale 22 generates output signals on the data communication line 48 which are indicative of the weight of an item positioned on the product scale 22.

The data input device 20 is coupled to the processing unit 12 through a data communication line 49. The data input device 20 may include one or more of a known keypad, a touch pad, a credit/debit card reader, or a smart card reader.

The processing unit 12 includes network interface circuitry (not shown) which conventionally permits the self-service checkout terminal 10 to communicate with the network 28 such as a LAN or WAN through a wired connection 46. The processing unit 12 communicates with the network 28 during the checkout procedure in order to communicate with a paging system (not shown) or the like which pages or otherwise alerts the retailers personnel as described further below. In addition, the processing unit 12 communicates with the network 28 to obtain information such as pricing information on an item being scanned, and also to verify customer credit approval when appropriate. The network interface circuitry associated with the self-service checkout terminal 10 may include a known Ethernet expansion card, and the wired connection 46 may include a known twisted-pair communication line. Alternatively, the network interface circuitry may support wireless communications with the network 28.

The processing unit 12 communicates with the memory device 30 via a data communication line 51. The memory device 30 is provided to maintain a number of electronic logs associated with operation of the self-service checkout terminal 10. More specifically, the memory device 30 electronically maintains an event log, a suspicion log, and a maintenance log.

The event log is provided to track or otherwise tally the number of occasions in which a given customer operates the self-service checkout terminal 10 improperly. In particular, the event log tracks those occasions in which the customer unintentionally operated the self-service checkout terminal 10 improperly, along with those occasions in which it can be inferred with a high degree of confidence that the customer intentionally operated the self-service checkout terminal 10 improperly for illicit purposes such as theft. For example, if the video system 16 detects that the customer passed an item across the scanning windows 14*a*, 14*b* of the scanner 14, but the product identification code was not read by the scanner 14, an entry is made in the event log. This is true since the product identification code may not have been read due to an unintentional improper orientation of the item being scanned. However, the possibility does exist that the customer may have intentionally prevented the product identification code from being read (e.g. by placing his or her thumb over the code while passing the item over the scanner 14). Therefore, an entry is made in the event log.

The suspicion log on the other hand, is provided to track or otherwise tally the number of occasions in which a given customer operates the self-service checkout terminal 10 improperly, and it can be inferred with a high degree of confidence that the customer was intentionally operating the self-service checkout terminal 10 improperly for illicit reasons such as theft. For example, if the light curtain device 24 detects that the customer placed an item in the post-scan area 27, but the video system 16 did not detect motion associated with the customer attempting to scan the item, and the scanner 14 did not read a product identification code associated with the item, it can be inferred with a high degree of confidence that the customer was intentionally operating the self-service checkout terminal 10 improperly. This is true since the customer apparently made no attempt to scan the item prior to placing the item in the post-scan area 27. Therefore, an entry is made in the suspicion log.

The maintenance log is provided to track or otherwise tally the number of occasions in which a given customer is using the self-service checkout terminal 10 properly, but a component of the self-service terminal 10 is not functioning correctly. For example, if the scanner 14 reads a product identification code associated with an item, but the video system 16 did not detect motion associated with a scanning attempt, the video system 16 may be out of calibration or otherwise in need of repair. Therefore, an entry is made in the maintenance log.

It should be appreciated that a predetermined threshold value may be established for each of the following: the event log, the suspicion log, and the maintenance log. More specifically, a retailer may establish a threshold value for each of the logs that once exceeded causes the processing unit 12 to communicate with the network 28 in order to page or otherwise alert the retailer's personnel as to certain events surrounding the operation of the self-service checkout terminal 10 by a given customer. For example, a customer service manager may be paged to assist the customer if the event log exceeds a value of three. Moreover, a security officer may be paged to audit or otherwise investigate the customer's transaction if the suspicion log exceeds a value of 11/2.

Figure 4:
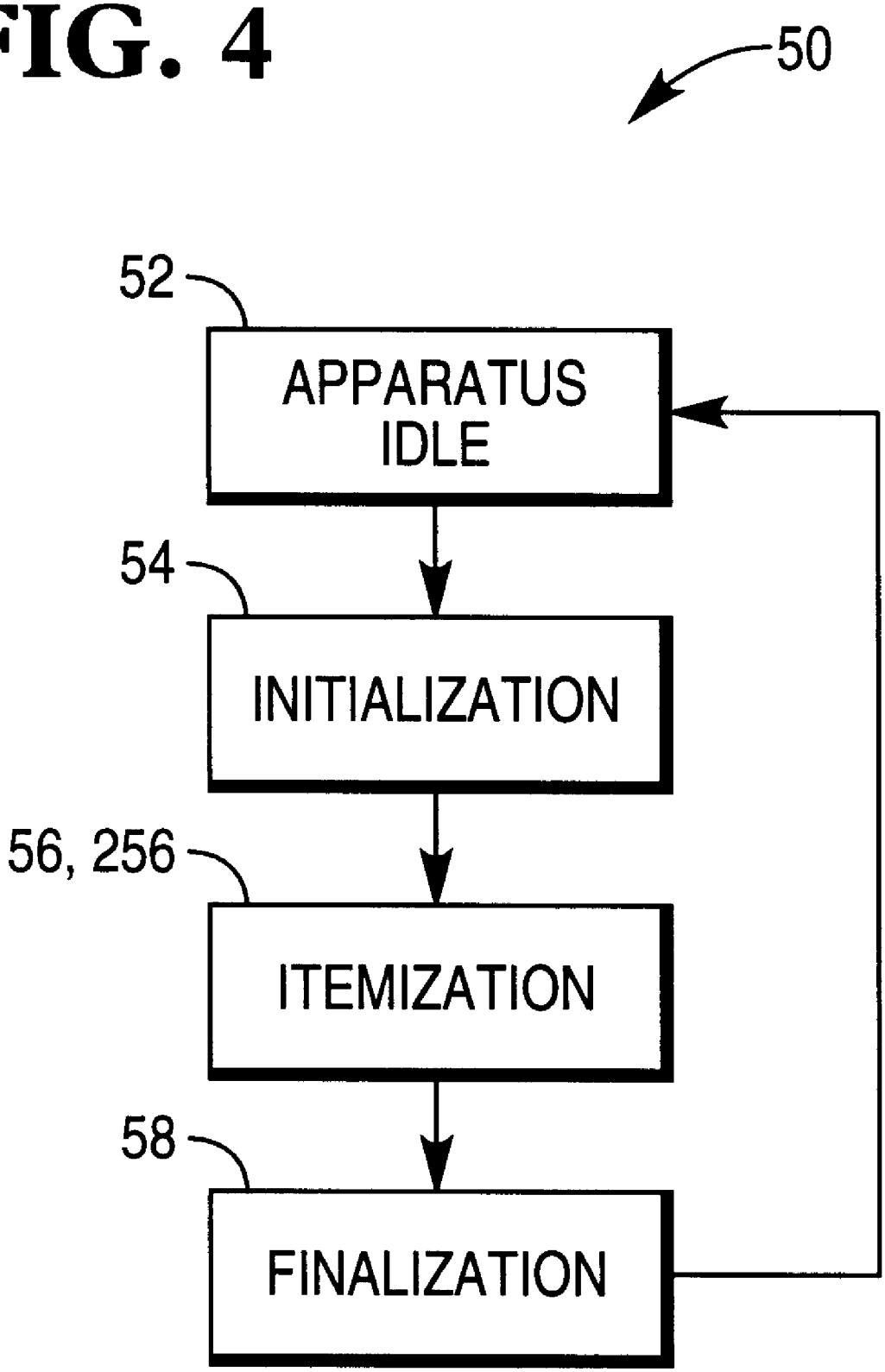
FIG. 4 is a flowchart setting forth the general procedure for checking out items through the self-service checkout terminal of FIG. 1.

Referring now to FIG. 4, there is shown a flowchart which sets forth a general procedure 50 for checking out items through the self-service checkout terminal 10. When a customer arrives at the self-service checkout terminal 10, the self-service checkout terminal 10 is in an idle state (step 52). An initialization step 54 is executed prior to checking out items for purchase. In particular, one or more initialization instructions are displayed on the display monitor 18 which instruct the customer to (1) select a desired method of payment, and/or (2) identify himself or herself by inserting a shopping card, debit card, credit card, smart card, etc. into a card reader 31 (see FIG. 1).

At the completion of the initialization step 54, the routine 50 advances to an itemization step 56 where the user scans the individual items for purchase across the scanner 14. Moreover, in step 56 the user weighs items such as produce or meat with the product scale 22, and thereafter enters the product identification code associated with the item via either the data input device 20 or by touching a particular area of the display monitor 18. At the completion of the itemization step 56, the routine 50 advances to a finalization step 58 in which (1) a grocery receipt is printed, and (2)

payment is tendered by either inserting currency into a cash acceptor (not shown), charging a credit card or debit card account, or decreasing a value amount stored on a smart card via the card reader 31. It should be appreciated that in the case of when a user inserts currency into the cash acceptor, the self-service checkout terminal 10 may provide change via a currency dispenser (not shown) and a coin dispenser (not shown). After completion of the finalization step 58, the routine 50 returns to step 52 in which the self-service checkout terminal 10 remains in the idle condition until a subsequent user initiates a checkout procedure.

Figure 5A:
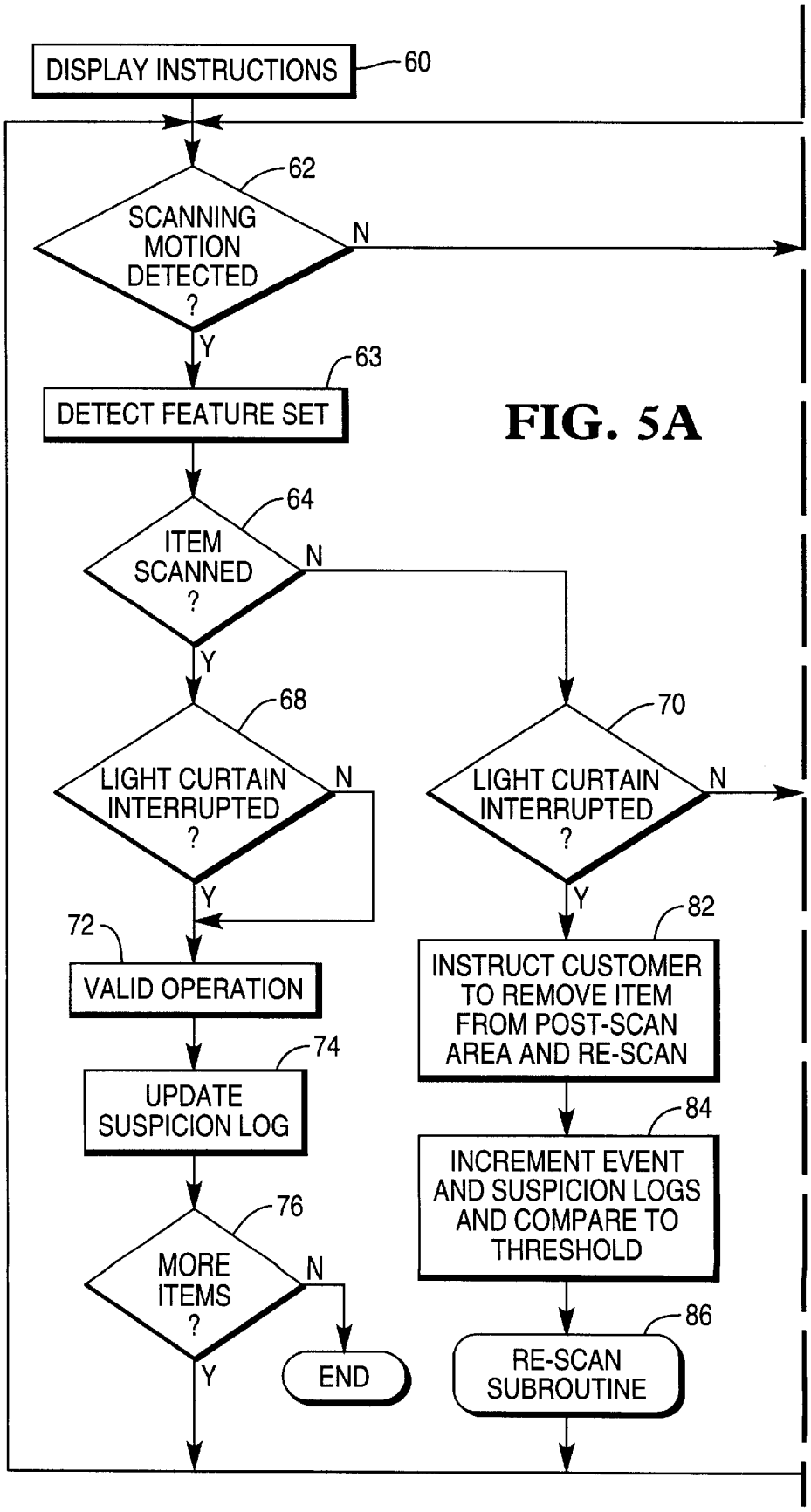
FIGS. 5A, 5B, and 5C collectively comprise FIG. 5 which is a flowchart setting forth in detail a first embodiment of the itemization step of the general procedure of FIG. 4.
Figure 5B:
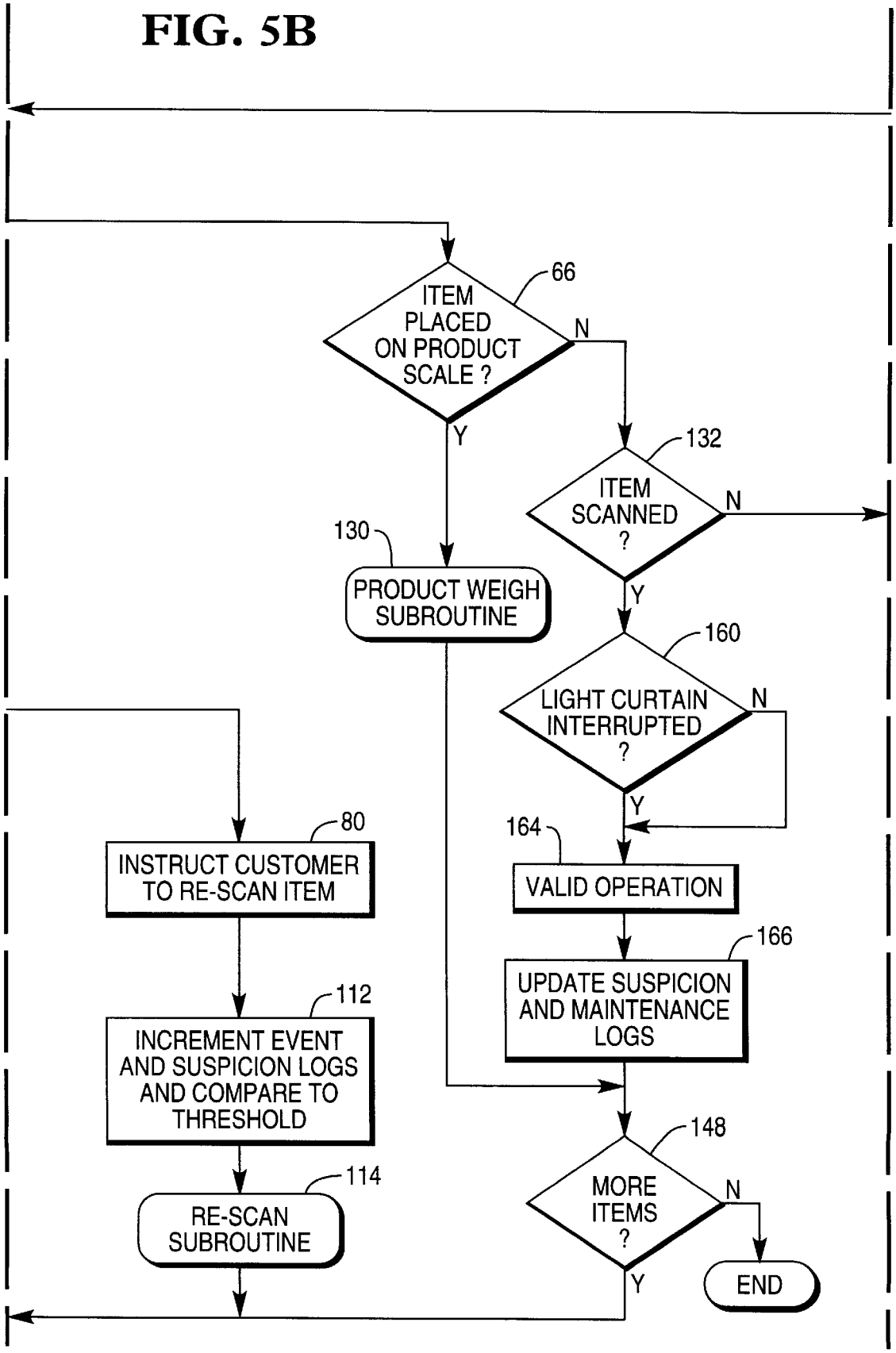
Figures 5, 5C:
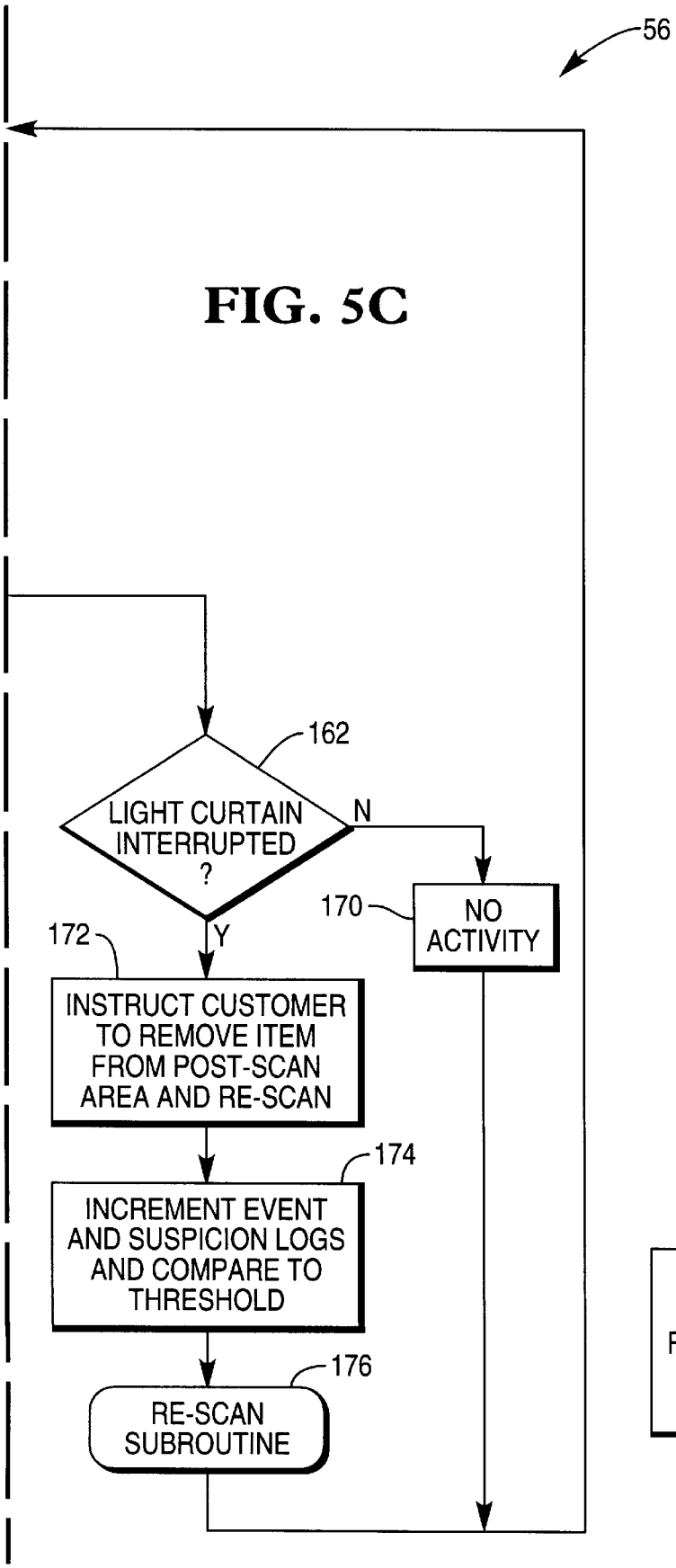

Referring now to FIG. 5, there is shown a flowchart setting forth the itemization step 56 in greater detail. After the initialization step 54 (see FIG. 4) is completed, the routine 56 advances to step 60 where a message is displayed on the display monitor 18 which instructs the customer to pass or otherwise scan individual items across or adjacent the scanner 14 with the product identification code facing one of the scanning windows 14*a*, 14*b*.

The routine 56 then advances to step 62 where the processing unit 12 scans or reads the data communication line 42 to determine whether the video system 16 has detected the customer scanning an item across the target area associated with the scanner 14. In particular, the video system 16 generates an output signal which is sent to the processing unit 12 once the video system 16 detects the motion of the customer scanning the item across the scanner 14. If a scanning motion is detected, the routine 56 advances to step 63. If a scanning motion is not detected, the routine 56 advances to step 66.

In step 63, the processing unit 12 stores into a memory location associated therewith a file which includes a digital image of a feature set associated with the item that was passed across the scanner 14 in step 62. What is meant herein by the term "feature set" is a number of physical characteristics associated with the item being scanned. For example, the feature set may include the size, shape, and color of the item. After the processing unit 12 determines the feature set associated with the item being scanned, the routine 56 advances to step 64.

In step 64, the processing unit 12 scans or reads the data communication line 40 to determine whether the scanner 14 has successfully read or otherwise captured the product identification code associated with the item. More specifically, the scanner 14 generates an output signal which is sent to the processing unit 12 once the scanner 14 successfully reads the product identification code associated with the item. If the code is successfully read from the item, an item-entered control signal is generated and the routine 56 advances to step 68. If the code is not successfully read from the item, the routine 56 advances to step 70.

In step 68, the processing unit 12 determines if the scanned item is placed in the post-scan area 27. More specifically, the light curtain device 24 generates an output or detection signal which is sent to the processing unit 12 once the light curtain 25 has been interrupted by the customer placing the item in the post-scan area 27. After scanning an item, the customer may opt not to immediately place the item in the post-scan area 27. For example, if the customer scanned a pack of gum, the customer may opt to place the gum into his or her pocket instead of placing the gum in the post-scan area 27. Hence, whether or not the light curtain device 24 generates an output signal in step 68, the routine 56 is advanced to step 72.

In step 72, the processing unit 12 determines that a successful checkout operation has been completed for the particular item selected for purchase. More specifically, the processing unit 12 concludes that the customer apparently scanned an item over the scanner 14 because the video system 16 generated an output signal on data communication line 42, and that the item was in fact scanned because the scanner 14 generated an output signal on the data communication line 40. The processing unit 12 may then communicate with the network 28 to obtain the price of the properly scanned item for use in generating a bill or receipt at the end of the checkout procedure. A valid-use control signal is generated and the routine 56 then advances to step 74.

In step 74, the processing unit updates the suspicion log. In particular, the processing unit 12 queries the memory device 30 to determine if the item that was successfully scanned in step 64 had previously been unsuccessfully scanned. If the customer has not previously attempted to scan the item that was successfully scanned in step 64, no change is made to the suspicion log. However, if the customer has previously tried to scan the item that was successfully scanned in step 64, the processing unit 12 determines what change, if any, should be made to the suspicion log.

As shall be discussed below in more detail, the processing unit 12 identifies events in which items are unsuccessfully scanned as either alpha-type events or beta-type events. The alpha-type events are those events in which the customer scanned an item unsuccessfully in a manner which is indicative of a relatively low probability that the customer is attempting to commit an impropriety such as theft. Conversely, the beta-type events are those events in which the customer scanned an item unsuccessfully in a manner which is indicative of a relatively high probability that the customer is attempting to commit an impropriety such as theft.

Therefore, in step 74, if the processing unit 12 determines that the item that was successfully scanned in step 64 was previously scanned unsuccessfully in an alpha-type event, the processing unit 12 causes the suspicion log to be decreased by a predetermined value such as ½. However, if the processing unit 12 determines that the item that was successfully scanned in step 64 was previously scanned unsuccessfully in a beta-type event, the processing unit 12 does not change the value of the suspicion log. The routine 56 then advances to step 76.

In step 76, the processing unit 12 monitors the communication line 49 from the data input device 20, the communication line 44 from the display monitor 18, the communication line 42 from the video system 16, and the communication line 40 from the scanner 14 in order to determine whether there are more items to be scanned. In particular, a message is displayed on the display monitor 18 instructing the customer to touch a particular touch screen area displayed on the display monitor 18, or to touch a particular key associated with the data input device 20, when the customer has completed scanning all of the items for purchase.

If a particular signal is detected on either of the communication lines 44 or 49, the processing unit 12 determines that the checkout procedure is complete and the routine 56 advances to the finalization step 58 (see FIG. 4). If a signal is detected on either one or both of the communication lines 42, 40, the processing unit 12 determines that the customer is attempting to scan another item for purchase, and the routine advances to step 62.

Returning to step 64, if the product identification code was not successfully read from the item being scanned, the routine 56 advances to step 70. Step 70 follows the same procedure outlined above with regard to step 68. In particular, the processing unit 12 determines if the unsuccessfully scanned item is placed in the post-scan area 27. More specifically, the light curtain device 24 generates an output or detection signal which is sent to the processing unit 12 once the light curtain 25 has been interrupted by the customer placing the unsuccessfully scanned item in the post-scan area 27. If the unsuccessfully scanned item is placed in the post-scan area 27, an invalid-use control signal is generated and the routine 56 advances to step 82. If the unsuccessfully scanned item is not placed in the post-scan area 27, the routine advances to step 80.

In step 82, the processing unit 12 causes a message to be displayed on the display monitor 18 which instructs the customer to remove the item from the post-scan area 27, and thereafter re-scan the item. The routine 56 then advances to step 84.

In step 84, the processing unit 12 increments the event log and the suspicion log by a predetermined value. More specifically, the processing unit 12 generates an output signal which is sent to the memory device 30 which causes the event log and the suspicion log to be incremented in the memory device 30 by a value of one.

Thereafter, the processing unit 12 determines if the total value of either the event log or the suspicion log exceeds the respective predetermined threshold value for each log. More specifically, if the event log exceeds its predetermined threshold value, the processing unit 12 causes an output signal to be sent to the network 28 which in turn pages or otherwise summons the retailer's personnel in order to assist the customer. In addition, if the suspicion log exceeds its predetermined threshold value, the processing unit 12 causes an output signal to be sent to the network 28 which in turn pages or otherwise summons the retailer's personnel such as security personnel to audit or otherwise investigate the customer's transaction. The routine 56 then advances to a re-scan subroutine 86.

Figure 6:
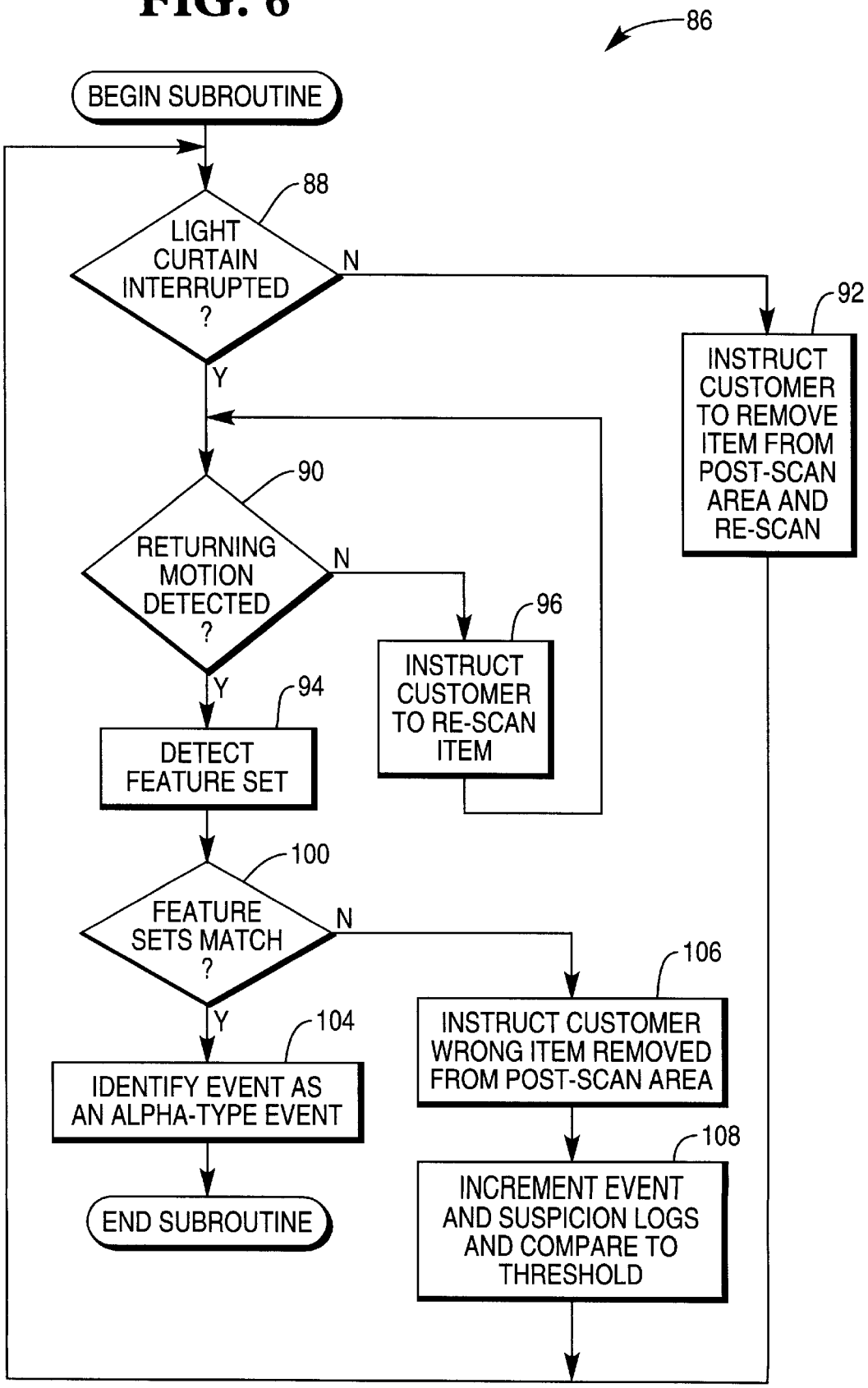
FIG. 6 is a flowchart setting forth in detail the re-scan subroutine 86 of the itemization step of FIG. 5.

Referring now to FIG. 6, there is shown a flow chart setting forth the re-scan subroutine 86 in greater detail. After completion of step 84 (see FIG. 5), the subroutine 86 advances to step 88. In step 88, the processing unit 12 determines if the customer removed the unsuccessfully scanned item from the post-scan area 27 as instructed. More specifically, the light curtain device 24 generates an output or removal signal which is sent to the processing unit 12 once the light curtain 25 has been interrupted thereby indicating that the customer removed the unsuccessfully scanned item from the post-scan area 27. If the unsuccessfully scanned item is removed from the post-scan area 27, the subroutine 86 advances to step 90. If the unsuccessfully scanned item is not removed from the post-scan area 27, the subroutine 86 advances to step 92.

In step 90, the processing unit 12 scans or reads the data communication line 42 to determine whether the video system 16 has detected motion associated with the customer moving the unsuccessfully scanned item across the target area of the scanner 14 in a direction which is opposite to the direction that the customer would move the item if the customer was attempting to scan the item. It should be appreciated that such motion is indicative of the customer returning the item to the area proximate the scanner 14 for a subsequent scanning attempt.

The video system 16 generates an output signal which is sent to the processing unit 12 once the video system 16 has detected the customer returning the unsuccessfully scanned item to the area proximate the scanner 14. If the unsuccessfully scanned item is returned to the area proximate the scanner 14, the subroutine 86 advances to step 94. If the unsuccessfully scanned item is not returned to the area proximate the scanner 14, the subroutine 86 advances to step 96.

In step 94, the processing unit 12 stores into a memory location associated therewith a file which includes a digital image of the feature set associated with the item that was returned across the area proximate scanner 14 in step 90. After the processing unit 12 determines the feature set associated with the item being returned, the subroutine 86 advances to step 100.

In step 100, the processing unit 12 determines if the feature set of the item that was removed from the post-scan area 27 matches the feature set of the item that was placed in the post-scan area 27. What is meant herein by the term "matches" is that the electronic file of the feature set of the item that was removed from the post-scan area 27 is determined to be the same as or within a predetermined tolerance range of the electronic file of the feature set of the item that was placed in the post-scan area 27. Therefore, in step 100 the processing unit 12 compares the electronic file of the feature set of the item that was removed from the post-scan area 27 (as detected in step 94) with the electronic file of the feature set of the item that was placed in the bag (as detected in step 63 of FIG. 3). If the feature set of the item being removed from the post-scan area 27 matches the feature set of the item that was placed into the post-scan area 27, a match control signal is generated and the subroutine 86 advances to step 104. If the feature set of the item being removed from the post-scan area 27 does not match the feature set of the item that was placed into the post-scan area 27, a mismatch control signal is generated and the subroutine 86 advances to step 106.

In step 104, the processing unit 12 determines that the customer has successfully removed the proper item from the post-scan area 27 in order to re-scan the item. In particular, the processing unit 12 concludes that (1) the customer removed an item from the post-scan area 27 (step 88), (2) the customer returned the item to the area proximate the scanner 14 (step 90), and (3) the feature set of the item removed from the post-scan area 27 matches the feature set of the item placed in the post-scan area 27 (step 100).

Further in step 104, the processing unit 12 determines that (1) there is a relatively low probability that the customer intentionally caused the item not to be scanned in step 64 (see FIG. 5), and (2) the customer properly removed the correct item for a subsequent re-scan attempt. Therefore, the processing unit identifies the event as an alpha-type event. More specifically, the processing unit 12 generates an output signal which is sent to the memory device 30 which identifies the event as an alpha-type event. Therefore, if the item is subsequently scanned correctly, the suspicion log will be decreased by a predetermined value as discussed above in regard to step 74. The subroutine 86 then ends thereby returning to step 62 of the routine 56 to monitor the re-scanning attempt of the item.

Returning now to step 100, if the feature set of the item removed from the post-scan area 27 does not match the feature set of the item that was placed in the post-scan area 27, a mismatch control signal is generated and the subroutine 86 advances to step 106. In step 106, the processing unit 12 causes a message to be displayed on the display monitor 18 which instructs the customer that the wrong item was removed from the post-scan area 27, and that the correct item should be removed from the post-scan area 27 for re-scanning. The subroutine 86 then advances to step 108.

In step 108, the processing unit 12 increments the event log and the suspicion log by a predetermined value. More specifically, the processing unit 12 generates an output signal which is sent to the memory device 30 which causes the event log and the suspicion log to be incremented in the memory device 30 by a value of one.

Thereafter, the processing unit 12 determines if the total value of either the event log or the suspicion log exceeds the respective predetermined threshold value for each log. More specifically, if the event log exceeds its predetermined threshold value, the processing unit 12 causes an output signal to be sent to the network 28 which in turn pages or otherwise summons the retailer's personnel in order to assist the customer. In addition, if the suspicion log exceeds its predetermined threshold value, the processing unit 12 causes an output signal to be sent to the network 28 which in turn pages or otherwise summons the retailer's personnel such as security personnel to audit or otherwise investigate the customer's transaction. If neither the event log nor the suspicion log exceeds its respective threshold value, the subroutine 86 then advances to step 88 to monitor the removal of a subsequent item from the post-scan area 27.

Returning now to step 90, if the unsuccessfully scanned item is not returned to the area proximate the scanner 14 within a reasonable period of time, the subroutine 86 advances to step 96. In step 96, the processing unit 12 causes a message to be displayed on the display monitor 18 which re-instructs the customer to re-scan the item which was removed from the post-scan area 27. The subroutine 86 then loops back to step 90.

Returning now to step 88, if the unsuccessfully scanned item is not removed from the post-scan area 27 within a reasonable period of time, the subroutine 86 advances to step 92. In step 92, the processing unit 12 causes a message to be displayed on the display monitor 18 which reinstructs the customer to remove the item from the post-scan area 27 and thereafter re-scan the item. The subroutine 86 then loops back to step 88.

Returning now to step 70 of the routine 56 (see FIG. 5), if the unsuccessfully scanned item is not placed in the post-scan area 27, the routine 56 advances to step 80. In step 80, the processing unit 12 causes a message to be displayed on the display monitor 18 which instructs the customer to re-scan the item. The routine 56 then advances to step 112.

Step 112 follows the same general procedure outlined above in regard to step 84. In particular, the processing unit 12 increments the event log and the suspicion log by a predetermined value. More specifically, the processing unit 12 generates an output signal which is sent to the memory device 30 which causes the event log and the suspicion log to be incremented in the memory device 30 by a value of one.

Thereafter, the processing unit 12 determines if the total value of either the event log or the suspicion log exceeds the respective predetermined threshold value for each log. More specifically, if the event log exceeds its predetermined threshold value, the processing unit 12 causes an output signal to be sent to the network 28 which in turn pages or otherwise summons the retailer's personnel in order to assist the customer. In addition, if the suspicion log exceeds its predetermined threshold value, the processing unit 12 causes an output signal to be sent to the network 28 which in turn pages or otherwise summons the retailer's personnel such as security personnel to audit or otherwise investigate the customer's transaction. If neither the event log nor the suspicion log exceeds its respective threshold value, the routine 56 then advances to a re-scan subroutine 114.

Figure 7:
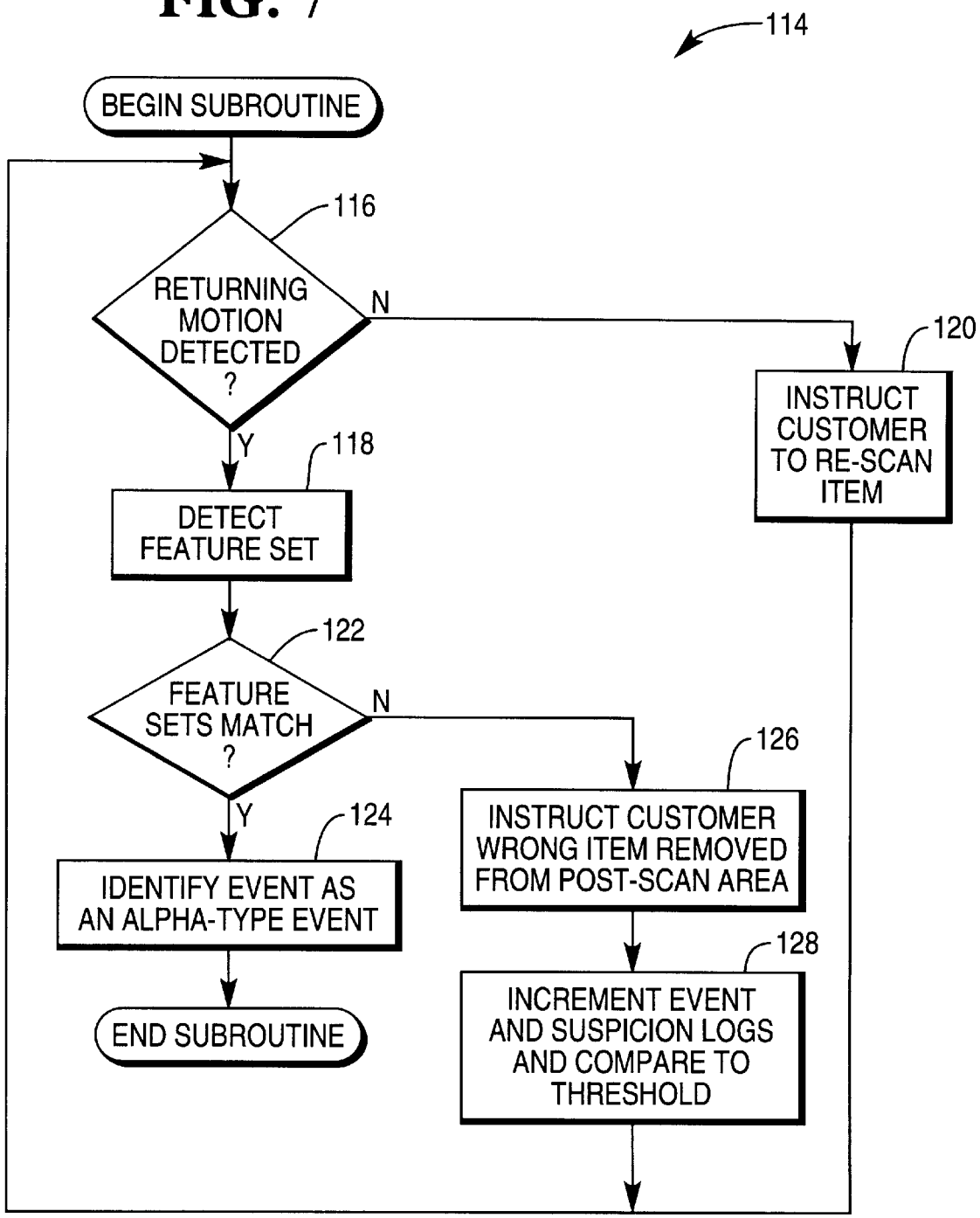
FIG. 7 is a flowchart setting forth in detail the re-scan subroutine 114 of the itemization step of FIG. 5.

Referring now to FIG. 7, there is shown a flow chart setting forth the re-scan subroutine 114 in greater detail. After completion of step 112 (see FIG. 5), the subroutine 114 advances to step 116. In step 116, the processing unit 12 scans or reads the data communication line 42 to determine whether the video system 16 has detected motion associated with the customer moving the unsuccessfully scanned item across the target area of the scanner 14 in a direction which is opposite to the direction that the customer would move the item if the customer was attempting to scan the item. It should be appreciated that such motion is indicative of the customer returning the item to the area proximate the scanner 14 for a subsequent scanning attempt.

The video system 16 generates an output signal which is sent to the processing unit 12 once the video system 16 has detected the customer returning the unsuccessfully scanned item to the area proximate the scanner 14. If the unsuccessfully scanned item is returned to the area proximate the scanner 14, the subroutine 114 advances to step 118. If the unsuccessfully scanned item is not returned to the area proximate the scanner 14, the subroutine 114 advances to step 120.

In step 118, the processing unit 12 stores into a memory location associated therewith a file which includes a digital image of the feature set associated with the item that was returned across the area proximate scanner 14 in step 116. After the processing unit 12 determines the feature set associated with the item being returned, the subroutine 114 advances to step 122.

In step 122, the processing unit 12 determines if the feature set of the item returned to the area proximate the scanner 14 matches the feature set of the item that was unsuccessfully scanned. In particular, the processing unit 12 compares the electronic file of the feature set of the item that was returned to the area proximate the scanner 14 (as detected in step 118) with the electronic file of the feature set of the item which was unsuccessfully scanned (as detected in step 63 of FIG. 5). If the feature set of the item being returned to the area proximate the scanner 14 matches the feature set of the item that was unsuccessfully scanned, a match control signal is generated and the subroutine 114 advances to step 124. If the feature set of the item being returned to the area proximate the scanner 14 does not match the feature set of the item that was unsuccessfully scanned, a mismatch control signal is generated and the subroutine 114 advances to step 126.

In step 124, the processing unit 12 determines that the customer has successfully returned the proper item to the area proximate the scanner 14 in order to re-scan the item. In particular, the processing unit 12 concludes that (1) the customer returned the item to the area proximate the scanner 14 (step 116), and (2) the feature set of the item returned to the area proximate the scanner 14 matches the feature set of the item which was unsuccessfully scanned (step 122).

The processing unit 12 determines that (1) there is a relatively low probability that the customer intentionally caused the item not to be scanned in step 64 (see FIG. 5), and (2) the customer properly returned the correct item for a subsequent re-scan attempt. Therefore, the processing unit identifies the event as an alpha-type event. More specifically, the processing unit 12 generates an output signal which is sent to the memory device 30 which identifies the event as an alpha-type event. Therefore, if the item is subsequently scanned correctly, the suspicion log will be decreased by a predetermined value as discussed above in regard to step 74. The subroutine 114 then ends thereby returning to step 62 of the routine 56 to monitor the re-scanning attempt of the item.

Returning now to step 122, if the feature set of the item returned to the area proximate the scanner 14 does not match the feature set of the item that was unsuccessfully scanned, a mismatch control signal is generated and the subroutine 114 advances to step 128. In step 126, the processing unit 12 causes a message to be displayed on the display monitor 18 which instructs the customer that the wrong item was returned to the area proximate the scanner 14 and that the correct item should be returned to the area proximate the scanner 14 for re-scanning. The subroutine 114 then advances to step 128.

In step 128, the processing unit 12 increments the event log and the suspicion log by a predetermined value. More specifically, the processing unit 12 generates an output signal which is sent to the memory device 30 which causes the event log and the suspicion log to be incremented in the memory device 30 by a value of one.

Thereafter, the processing unit 12 determines if the total value of either the event log or the suspicion log exceeds the respective predetermined threshold value for each log. More specifically, if the event log exceeds its predetermined threshold value, the processing unit 12 causes an output signal to be sent to the network 28 which in turn pages or otherwise summons the retailer's personnel in order to assist the customer. In addition, if the suspicion log exceeds its predetermined threshold value, the processing unit 12 causes an output signal to be sent to the network 28 which in turn pages or otherwise summons the retailer's personnel such as security personnel to audit or otherwise investigate the customer's transaction. If neither the event log nor the suspicion log exceeds its respective threshold value, the subroutine 114 then advances to step 116 to monitor the return of a subsequent item to the area proximate the scanner 14.

Returning now to step 116, if the unsuccessfully scanned item is not returned to the area proximate the scanner 14 within a reasonable period of time, the subroutine 114 advances to step 120. In step 120, the processing unit 12 causes a message to be displayed on the display monitor 18 which re-instructs the customer to re-scan the item. The subroutine 114 then loops back to step 116.

Returning to step 62 (see FIG. 5), if a scanning motion across the scanner 14 is not detected, the routine 56 advances to step 66. In step 66, the processing unit 12 scans or reads the data communication line 42 to determine whether the video system 16 has detected the customer placing an item on the product scale 22. In particular, the video system 16 generates an output signal which is sent to the processing unit 12 once the video system 16 detects the motion of the customer placing the item on the product scale 22. If an item is detected on the product scale 22, the routine 56 advances to a product weigh subroutine 130. If an item is not detected on the product scale 22, the routine 56 advances to step 132.

Figure 8A:
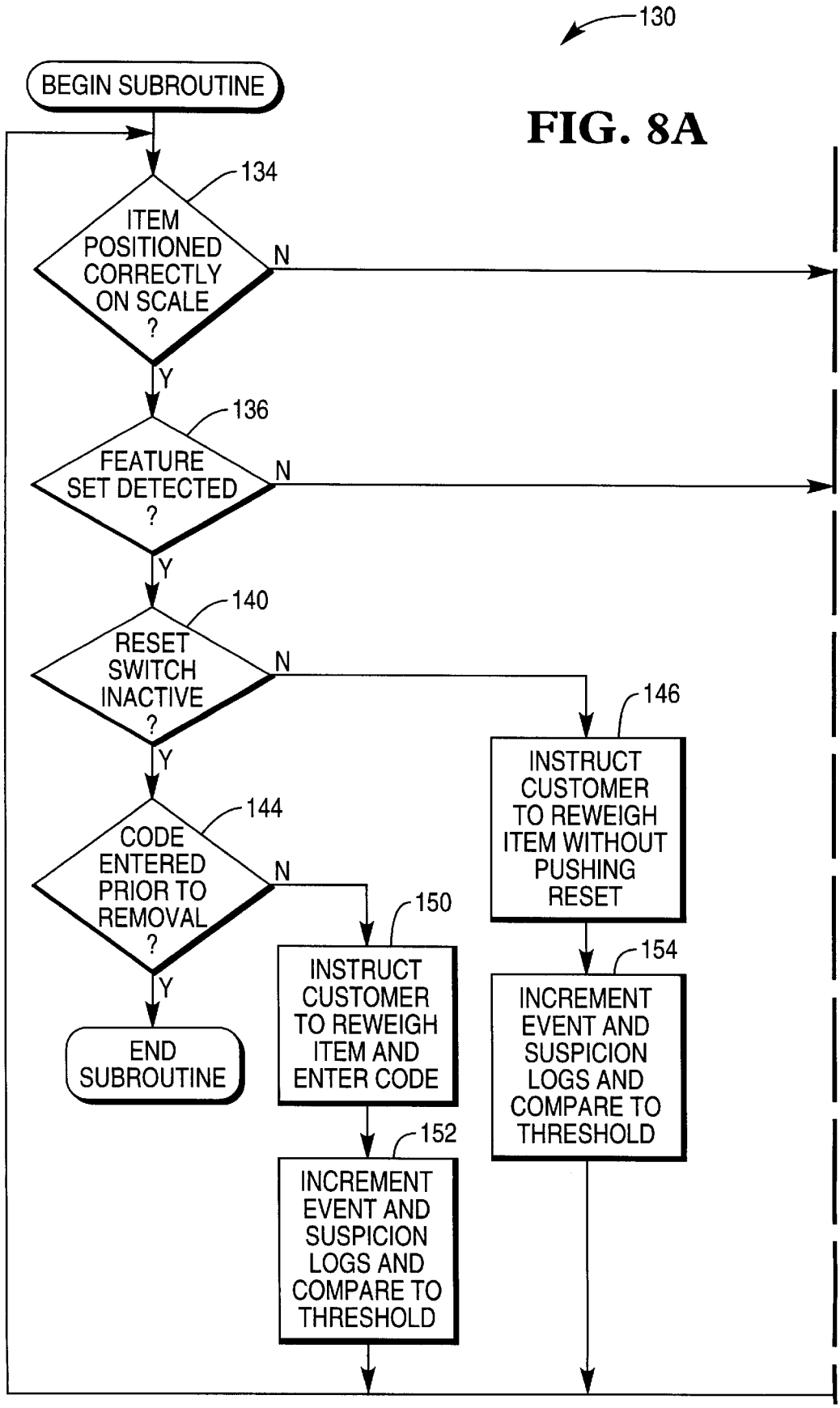
FIGS. 8A and 8B collectively comprise FIG. 8 which is a flowchart setting forth in detail the product weigh subroutine 130 of the itemization step of FIG. 5.
Figure 8B:
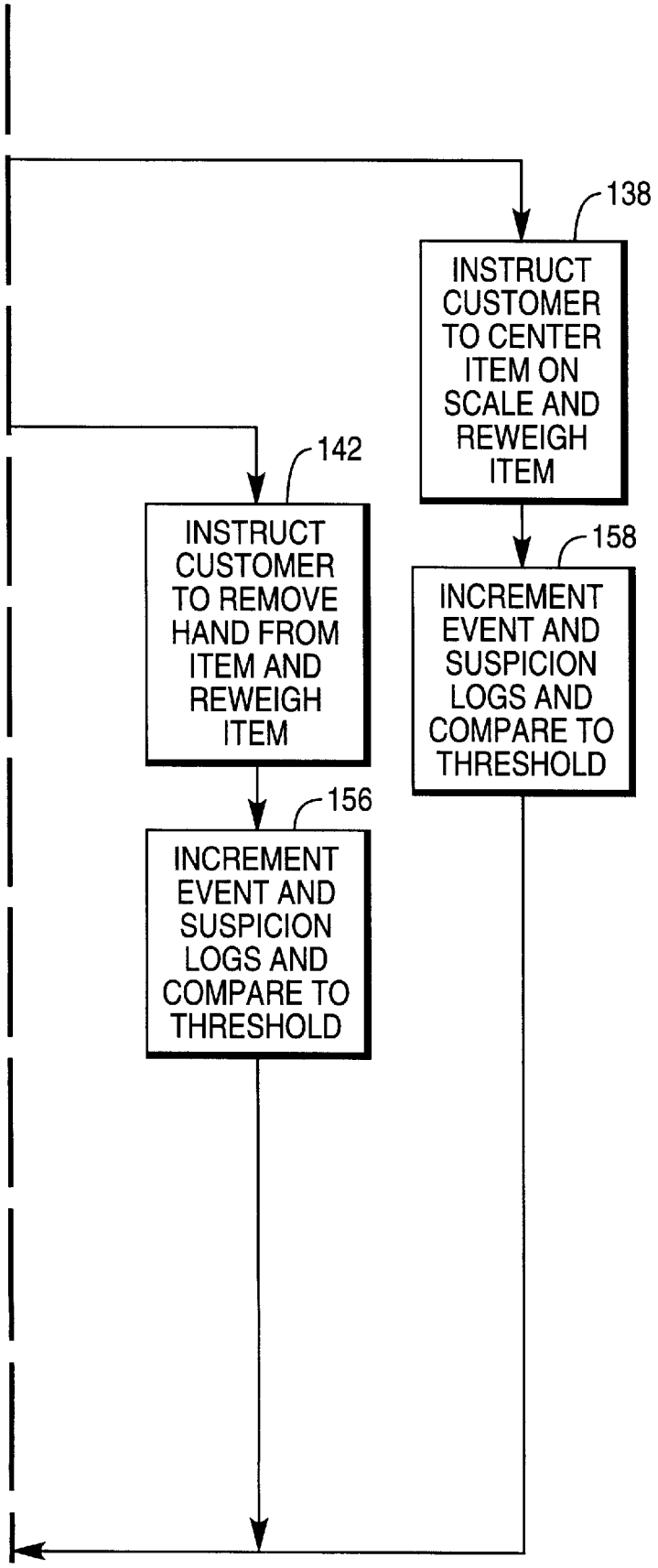

Referring now to FIG. 8, there is shown a flow chart setting forth the product weigh subroutine 130 in greater detail. After completion of step 66 (see FIG. 5), the subroutine 130 advances to step 134. In step 134, the processing unit 12 scans or reads the data communication line 42 to determine whether the video system 16 has detected that the customer has correctly positioned the item to be weighed on the product scale 22. In particular, since the product scale 22 is integrated with the scanner 14, the video system 16 determines if the entire item is positioned on the product scale 22 by determining if the entire item is within the target area of the scanner 14. It should be appreciated that if a portion of the item being weighed on the product scale 22 is not positioned on the product scale 22, the measured weight of the item may be erroneously low. If the item to be weighed is positioned correctly on the product scale 22, the subroutine 130 advances to step 136. If the item to be weighed is not positioned correctly on the product scale 22, the subroutine 130 advances to step 138.

In step 136, the processing unit 12 scans or reads the data communication line 42 to determine whether the video system 16 has detected the feature set associated with the item positioned on the product scale 22. It should be appreciated that the inability of the video system 16 to detect the feature set associated with the item positioned on the product scale 22 may be caused by the customer keeping his or her hand on the item as the product scale 22 attempts to weigh the item thereby potentially causing the measured weight of the item to be erroneously low. If the feature set associated with the item positioned on the product scale 22 is determined, the subroutine 130 advances to step 140. If the feature set associated with the item positioned on the product scale 22 is not determined, the subroutine 130 advances to step 142.

In step 140, the processing unit 12 scans or reads the data communication line 48 to determine whether a reset switch (not shown) associated with the product scale 22 has been pushed or otherwise activated by the customer. It should be appreciated that activation of the reset switch of the product scale 22 may cause the measured weight of the item to be erroneously low or even non-existent. If the reset switch is inactive or has otherwise not been pushed by the customer while the item is positioned on the product scale 22, the subroutine 130 advances to step 144. If the reset switch is pushed by the customer while the item is positioned on the product scale 22, the subroutine 130 advances to step 146.

In step 144, the processing unit 12 scans or otherwise reads the data communication line 49 to determine if the customer has properly input the product code associated with the item being weighed via the data input device 20 prior to removal of the item from the product scale 22. It should be appreciated that the processing unit 12 uses the product code to communicate with the network 28 to obtain the price of the properly weighed item for use in generating a bill or receipt at the end of the checkout procedure. If the product code associated with the item is properly entered via the data input device 20 prior to removal of the item from product scale 22, an item-entered control signal is generated and the subroutine 130 then ends thereby returning to step 148 in the routine 56 (see FIG. 5). If the product code associated with the item is not properly entered via the data input device 20 prior to removal of the item from the product scale 22, the subroutine 130 advances to step 150.

Step 148 (see FIG. 5) follows the same procedure outlined above in regard to step 76. In particular, the processing unit 12 monitors the communication line 49 from the data input device 20, the communication line 44 from the display monitor 18, the communication line 42 from the video system 16, and the communication line 40 from the scanner 14 in order to determine whether there are more items to be scanned. More specifically, a message is displayed on the display monitor 18 instructing the customer to touch a particular touch screen area displayed on the display monitor 18, or to touch a particular key associated with the data input device 20, when the customer has completed scanning all of the items for purchase.

If a particular signal is detected on either of the communication lines 44 or 49, the processing unit 12 determines that the checkout procedure is complete and the routine 56 advances to the finalization step 58 (see FIG. 4). If a signal is detected on either one or both of the communication lines 42, 40, the processing unit 12 determines that the customer is attempting to scan another item for purchase, and the routine advances to step 62.

Returning now to step 144 (see FIG. 8), if the product code associated with the item being weighed is not properly entered via the data input device 20 prior to removal of the item from the product scale 22, the subroutine 130 advances to step 150. In step 150, the processing unit 12 causes a message to be displayed on the display monitor 18 which instructs the customer to reweigh the last item and enter a product code associated therewith. The subroutine 130 then advances to step 152.

In step 152, the processing unit 12 increments the event log and the suspicion log by a predetermined value. More specifically, the processing unit 12 generates an output signal which is sent to the memory device 30 which instructs the memory device 30 to increment both the event log and the suspicion log by a value of one.

Thereafter, the processing unit 12 determines if the total value of either the event log or the suspicion log exceeds the respective predetermined threshold value for each log. More specifically, if the event log exceeds its predetermined threshold value, the processing unit 12 causes an output signal to be sent to the network 28 which in turn pages or otherwise summons the retailer's personnel in order to assist the customer. In addition, if the suspicion log exceeds its predetermined threshold value, the processing unit 12 causes an output signal to be sent to the network 28 which in turn pages or otherwise summons the retailer's personnel such as security personnel to audit or otherwise investigate the customer's transaction. If neither the event log nor the suspicion log exceeds its respective threshold value, the subroutine 130 then advances to step 134 to monitor the customer's attempt to reweigh the item.

Returning now to step 140, if the reset switch is pushed by the customer while the item is positioned on the product scale 22, the subroutine 130 advances to step 146. In step 146, the processing unit 12 causes a message to be displayed on the display monitor 18 which instructs the customer to reweigh the last item without pushing the reset switch. The subroutine 130 then advances to step 154.

Step 154 follows the same procedure outlined above in regard to step 152. In particular, the processing unit 12 increments the event log and the suspicion log by a predetermined value. More specifically, the processing unit 12 generates an output signal which is sent to the memory device 30 which instructs the memory device 30 to increment both the event log and the suspicion log by a value of one.

Thereafter, the processing unit 12 determines if the total value of either the event log or the suspicion log exceeds the respective predetermined threshold value for each log. More specifically, if the event log exceeds its predetermined threshold value, the processing unit 12 causes an output signal to be sent to the network 28 which in turn pages or otherwise summons the retailer's personnel in order to assist the customer. In addition, if the suspicion log exceeds its predetermined threshold value, the processing unit 12 causes an output signal to be sent to the network 28 which in turn pages or otherwise summons the retailer's personnel such as security personnel to audit or otherwise investigate the customer's transaction. If neither the event log nor the suspicion log exceeds its respective threshold value, the subroutine 130 then advances to step 134 to monitor the customer's attempt to reweigh the item.

Returning now to step 136, if the feature set associated with the item positioned on the product scale 22 is not determined, the subroutine 130 advances to step 142. In step 142, the processing unit 12 causes a message to be displayed on the display monitor 18 which instructs the customer to reweigh the last item without placing his or her hand on the item. The subroutine 130 then advances to step 156.

Step 156 follows the same procedure outlined above in regard to steps 152 and 154. In particular, the processing unit 12 increments the event log and the suspicion log by a predetermined value. More specifically, the processing unit 12 generates an output signal which is sent to the memory device 30 which instructs the memory device 30 to increment both the event log and the suspicion log by a value of one.

Thereafter, the processing unit 12 determines if the total value of either the event log or the suspicion log exceeds the respective predetermined threshold value for each log. More specifically, if the event log exceeds its predetermined threshold value, the processing unit 12 causes an output signal to be sent to the network 28 which in turn pages or otherwise summons the retailers personnel in order to assist the customer. In addition, if the suspicion log exceeds its predetermined threshold value, the processing unit 12 causes an output signal to be sent to the network 28 which in turn pages or otherwise summons the retailer's personnel such as security personnel to audit or otherwise investigate the customer's transaction. If neither the event log nor the suspicion log exceeds its respective threshold value, the subroutine 130 then advances to step 134 to monitor the customer's attempt to reweigh the item.

Returning now to step 134, if the item to be weighed is not positioned correctly on the product scale 22, the subroutine 130 advances to step 138. In step 138, the processing unit 12 causes a message to be displayed on the display monitor 18 which instructs the customer to center the item on the product scale 22. The subroutine 130 then advances to step 158.

Step 158 follows the same procedure outlined above in regard to step 152, 154, and 156. In particular, the processing unit 12 increments the event log and the suspicion log by a predetermined value. More specifically, the processing unit 12 generates an output signal which is sent to the memory device 30 which instructs the memory device 30 to increment both the event log and the suspicion log by a value of one.

Thereafter, the processing unit 12 determines if the total value of either the event log or the suspicion log exceeds the respective predetermined threshold value for each log. More specifically, if the event log exceeds its predetermined threshold value, the processing unit 12 causes an output signal to be sent to the network 28 which in turn pages or otherwise summons the retailer's personnel in order to assist the customer. In addition, if the suspicion log exceeds its predetermined threshold value, the processing unit 12 causes an output signal to be sent to the network 28 which in turn pages or otherwise summons the retailer's personnel such as security personnel to audit or otherwise investigate the customer's transaction. If neither the event log nor the suspicion log exceeds its respective threshold value, the subroutine 130 then advances to step 134 to monitor the customer's attempt to reweigh the item.

Returning now to step 66 (see FIG. 5), if an item is not detected on the product scale 22, the routine 56 advances to step 132. Step 132 follows the same procedure outlined above with regard to step 64. In particular, the processing unit 12 scans or reads the data communication line 40 to determine whether the scanner 14 has successfully read or otherwise captured the bar code associated with the item. More specifically, the scanner 14 generates an output signal which is sent to the processing unit 12 once the scanner 14 successfully reads the product identification code off of the item. If the code is successfully read from the item, an item-entered control signal is generated and the routine 56 advances to step 160. If the code is not successfully read from the item, the routine 56 advances to step 162.

Step 160 follows the same procedure outlined above in regard to step 68. In particular, the processing unit 12 determines if the scanned item is placed in the post-scan area 27. More specifically, the light curtain device 24 generates an output or detection signal which is sent to the processing unit 12 once the light curtain 25 has been interrupted by the customer placing the item in the post-scan area 27. As discussed above, the customer may opt not to immediately place the item in the post-scan area 27 after scanning an item (e.g. the customer may opt to place a pack of gum into his or her pocket after scanning the gum instead of placing it in the post-scan area 27). Hence, whether or not the light curtain device 24 generates an output signal in step 160, the routine 56 is advanced to step 164.

In step 164, the processing unit 12 determines that a successful checkout operation has been completed for the particular item selected for purchase. More specifically, the processing unit 12 concludes that the customer apparently scanned an item over the scanner 14 because the scanner 14 generated an output signal on the data communication line 40. However, because the video system 16 did not generate an output signal on the data communication line 42, the processing unit 12 concludes that the video system 16 may not be functioning properly. The processing unit 12 then communicates with the network 28 to obtain the price of the properly scanned item for use in generating a bill or receipt at the end of the checkout procedure. A valid-use control signal is generated and the routine 56 then advances to step 166.

In step 166, the processing unit updates the suspicion log. In particular, the processing unit 12 queries the memory device 30 to determine if the item that was successfully scanned in step 132 had previously been unsuccessfully scanned. If the customer has not previously attempted to scan the item that was successfully scanned in step 132, no change is made to the suspicion log. However, if the customer has previously attempted to scan the item which was successfully scanned in step 132, the processing unit 12 determines what change, if any, should be made to the suspicion log.

As discussed above, if the processing unit 12 determines that the item that was successfully scanned in step 132 was previously unsuccessfully scanned in an alpha-type event, the processing unit 12 causes the suspicion log to be decreased by a predetermined value such as ½. However, if the processing unit 12 determines that the item that was successfully scanned in step 132 was previously scanned unsuccessfully in a beta-type event, the processing unit 12 does not change the value of the suspicion log.

Since the processing unit 12 also determined that the video system 16 may not be functioning properly in step 164, the processing unit 12 increments the maintenance log thereby recording the potential malfunction of the video system 16. If the value of the maintenance log exceeds a predetermined threshold, an error message is sent across the network 28 by the processing unit 12 thereby requesting immediate maintenance attention. The routine 56 then advances to step 148.

As discussed above, in step 148 the processing unit 12 monitors the communication line 49 from the data input device 20, the communication line 44 from the display monitor 18, the communication line 42 from the video system 16, and the communication line 40 from the scanner 14 in order to determine whether there are more items to be scanned. In particular, a message is displayed on the display monitor 18 instructing the customer to touch a particular touch screen area displayed on the display monitor 18, or to touch a particular key associated with the data input device 20, when the customer has completed scanning all of the items for purchase.

If a particular signal is detected on either of the communication lines 44 or 49, the processing unit 12 determines that the checkout procedure is complete and the routine 56 advances to the finalization step 58 (see FIG. 4). If a signal is detected on either one or both of the communication lines 42, 40, the processing unit 12 determines that the customer is attempting to scan another item for purchase, and the routine advances to step 62.

Returning now to step 132, if the product identification code was not successfully read from the item being scanned, the routine 56 advances to step 162. Step 162 follows the same procedure outlined above with regard to step 68. In particular, the processing unit 12 determines if the unscanned item is placed in the post-scan area 27. More specifically, the light curtain device 24 generates an output or detection signal which is sent to the processing unit 12 once the light curtain 25 has been interrupted by the customer placing the unscanned item in the post-scan area 27. If the unscanned item is placed in the post-scan area 27, an invalid-use control signal is generated and the routine 56 advances to step 172. If the unscanned item is not placed in the post-scan area 27, the routine advances to step 170.

In step 172, the processing unit 12 causes a message to be displayed on the display monitor 18 which instructs the customer to remove the item from the post-scan area 27, and thereafter re-scan the item. The routine 56 then advances to step 174.

In step 174, the processing unit 12 increments the event log and the suspicion log by a predetermined value. More specifically, the processing unit 12 generates an output signal which is sent to the memory device 30 which causes the event log and the suspicion log to be incremented in the memory device 30 by a value of one.

Thereafter, the processing unit 12 determines if the total value of either the event log or the suspicion log exceeds the respective predetermined threshold value for each log. More specifically, if the event log exceeds its predetermined threshold value, the processing unit 12 causes an output signal to be sent to the network 28 which in turn pages or otherwise summons the retailer's personnel in order to assist the customer. In addition, if the suspicion log exceeds its predetermined threshold value, the processing unit 12 causes an output signal to be sent to the network 28 which in turn pages or otherwise summons the retailer's personnel such as security personnel to audit or otherwise investigate the customer's transaction. If neither the event log nor the suspicion log exceeds its respective threshold value, the routine 56 then advances to a re-scan subroutine 176.

Figure 9:
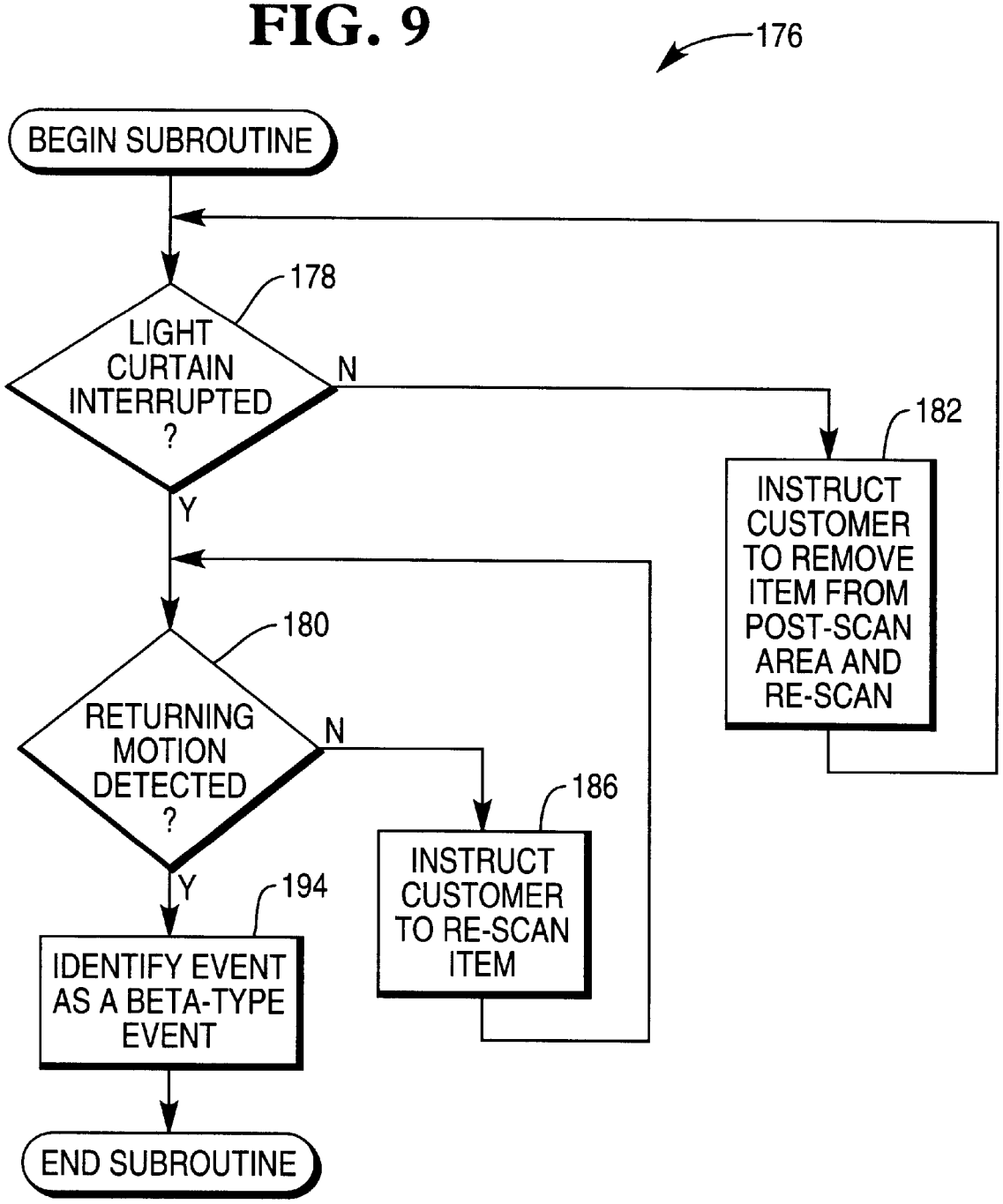
FIG. 9 is a flowchart setting forth in detail the re-scan subroutine 176 of the itemization step of FIG. 5.

Referring now to FIG. 9, there is shown a flow chart setting forth the re-scan subroutine 176 in greater detail. After completion of step 174 (see FIG. 5), the subroutine 176 advances to step 178. In step 178, the processing unit 12 determines if the customer removed the unscanned item from the post-scan area 27 as instructed. More specifically, the light curtain device 24 generates an output or removal signal which is sent to the processing unit 12 once the light curtain 25 has been interrupted thereby indicating that the customer removed the unscanned item from the post-scan area 27. If the unscanned item is removed from the post-scan area 27, the subroutine 176 advances to step 180. If the unscanned item is not removed from the post-scan area 27, the subroutine 176 advances to step 182.

In step 180, the processing unit 12 scans or reads the data communication line 42 to determine whether the video system 16 has detected motion associated with the customer moving the unscanned item across the target area of the scanner 14 in a direction which is opposite to the direction that the customer would move the item if the customer was attempting to scan the item. It should be appreciated that motion is indicative of the customer returning the item to the area proximate the scanner 14 for a subsequent scanning attempt.

The video system 16 generates an output signal which is sent to the processing unit 12 once the video system 16 has detected the customer returning the unscanned item to the area proximate the scanner 14. If the unscanned item is returned to the area proximate the scanner 14, the subroutine 176 advances to step 194. If the unscanned item is not returned to the area proximate the scanner 14, the subroutine 176 advances to step 186.

In step 194, the processing unit 12 determines that the customer has successfully removed the item from the post-scan area 27 in order to re-scan the item. In particular, the processing unit 12 concludes that (1) the customer removed an item from the post-scan area 27 (step 178), and (2) the customer returned the item to the area proximate the scanner 14 (step 180).

Further in step 194, the processing unit 12 determines (1) there is a relatively high probability that the customer is attempting to commit an impropriety such as theft since (1) motion indicative of a scanning attempt was not detected in step 62 (see FIG. 5), (2) the item was in fact not scanned in step 132, and (3) the item was nonetheless placed in the post-scan area 27 in step 162. Therefore, the processing unit 12 identifies the event as a beta-type event. More specifically, the processing unit 12 generates an output signal which is sent to the memory device 30 which identifies the event as a beta-type event. Therefore, even if the item is subsequently scanned correctly, the suspicion log will not be decreased. The subroutine 176 then ends thereby returning to step 62 of the routine 56 to monitor the re-scanning attempt of the item.

Returning now to step 180, if the unscanned item is not returned to the area proximate the scanner 14 within a reasonable period of time, the subroutine 176 advances to step 186. In step 186, the processing unit 12 causes a message to be displayed on the display monitor 18 which reinstructs the customer to re-scan the item which was removed from the post-scan area 27. The subroutine 176 then loops back to step 180.

Returning now to step 178, if the unscanned item is not removed from the post-scan area 27 within a reasonable period of time, the subroutine 176 advances to step 182. In step 182, the processing unit 12 causes a message to be displayed on the display monitor 18 which re-instructs the customer to remove the item from the post-scan area 27 and thereafter re-scan the item. The subroutine 176 then loops back to step 178.

Returning now to step 162 of the routine 56 (see FIG. 5), if the light curtain 25 is not interrupted, the routine 56 advances to step 170. In step 170, since (1) the video system 16 did not generate an output signal on the data communication line 42 indicating that a scanning motion was detected in the target area of the scanner 14, (2) the video system 16 did not generate an output signal on the data communication line 42 indicating that an item was placed on the product scale 22, (3) the scanner 14 did not generate an output signal on the data communication line 40 indicating an item was scanned, and (4) the light curtain device 24 did not generate an output signal on the data communication line 50 indicating an item was placed in the post-scan area 27, the processing unit 12 concludes that there is no present attempt being made by the customer to scan or otherwise checkout an item. Thus, the routine 56 advances to step 62 to loop through the routine 56 once again.

The video system 16 may also be configured in order to further enhance the security of the self-service checkout terminal 10. In particular, the video system 16 may be configured to have a third target area. The third target area of the video system 16 is defined by an area proximate the post-scan area 27. It should therefore be appreciated that motion proximate the post-scan area 27 is indicative of an item being moved relative to the post-scan area 27. The video system 16 may be therefore be used in conjunction with the light curtain device 24 in order to monitor the post-scan area 27. In particular, as shall be discussed below, the video system 16 may be used to detect (1) presence of an item proximate the post-scan area 27, and (2) the feature set of the item, whereas the light curtain device 24 may be used to determine if the item detected by the video system 16 is actually placed in or removed from the post-scan area 27 (i.e. if the item detected by the video system 16 is actually positioned on or removed from the post-scan set-aside surface 19*b*, or if the item detected by the video system 16 is placed in or removed from one of the grocery bags 17).

Figure 10A:
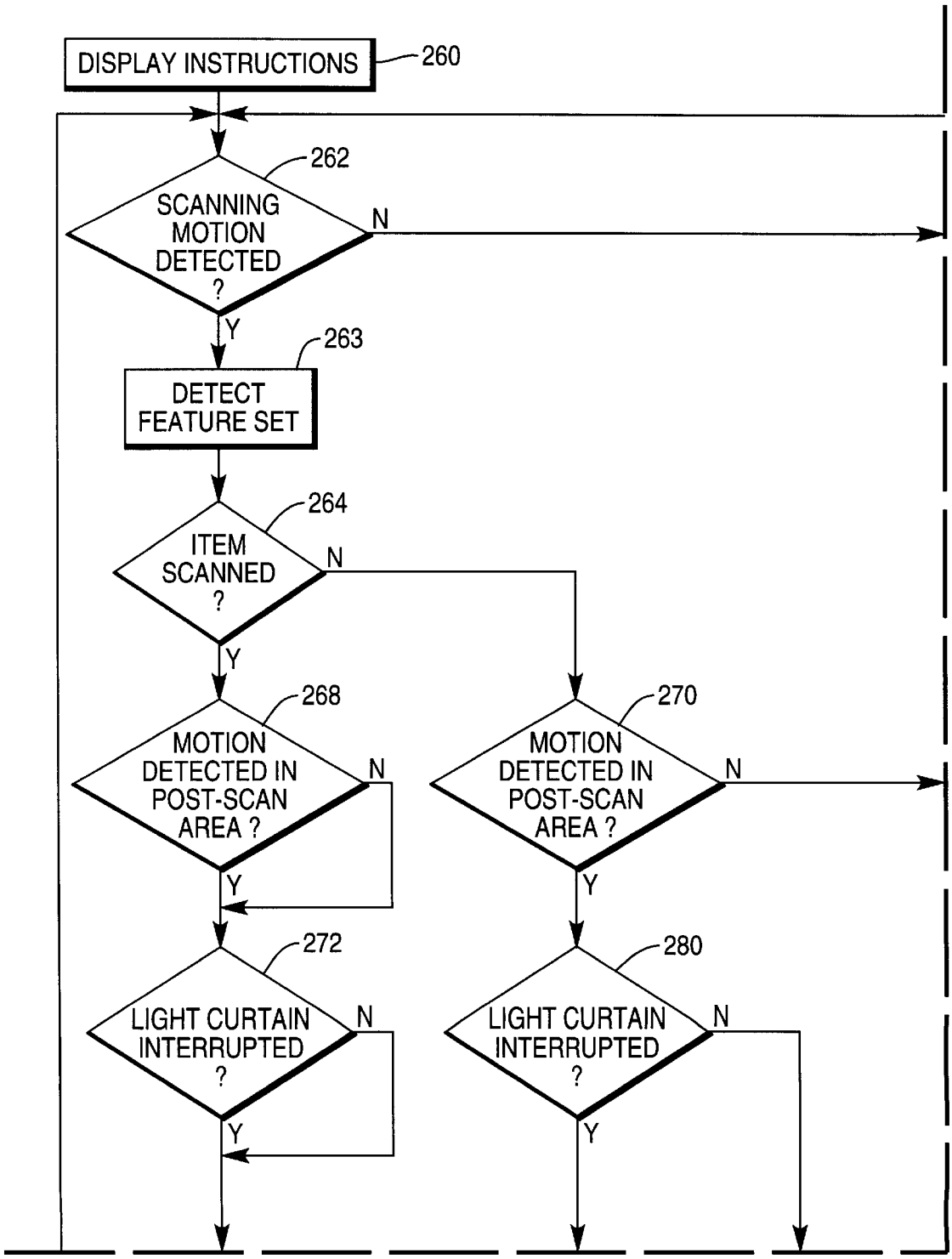
FIGS. 10A, 10B, 10C, 10D, 10E, and 10F collectively comprise FIG. 10 which is a flowchart setting forth in detail a second embodiment of the itemization step of the general procedure of FIG. 4.
Figure 10B:
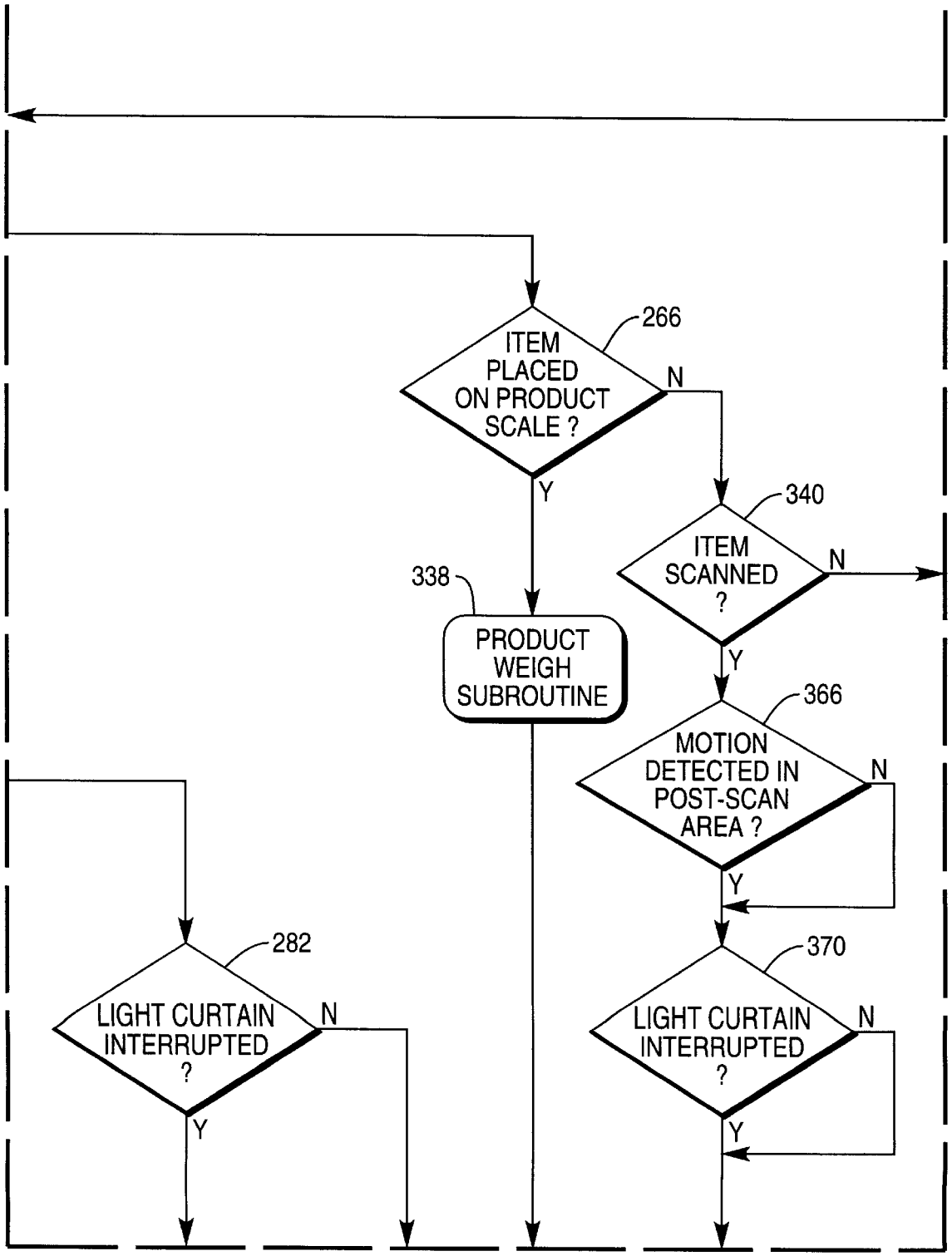
Figure 10C:
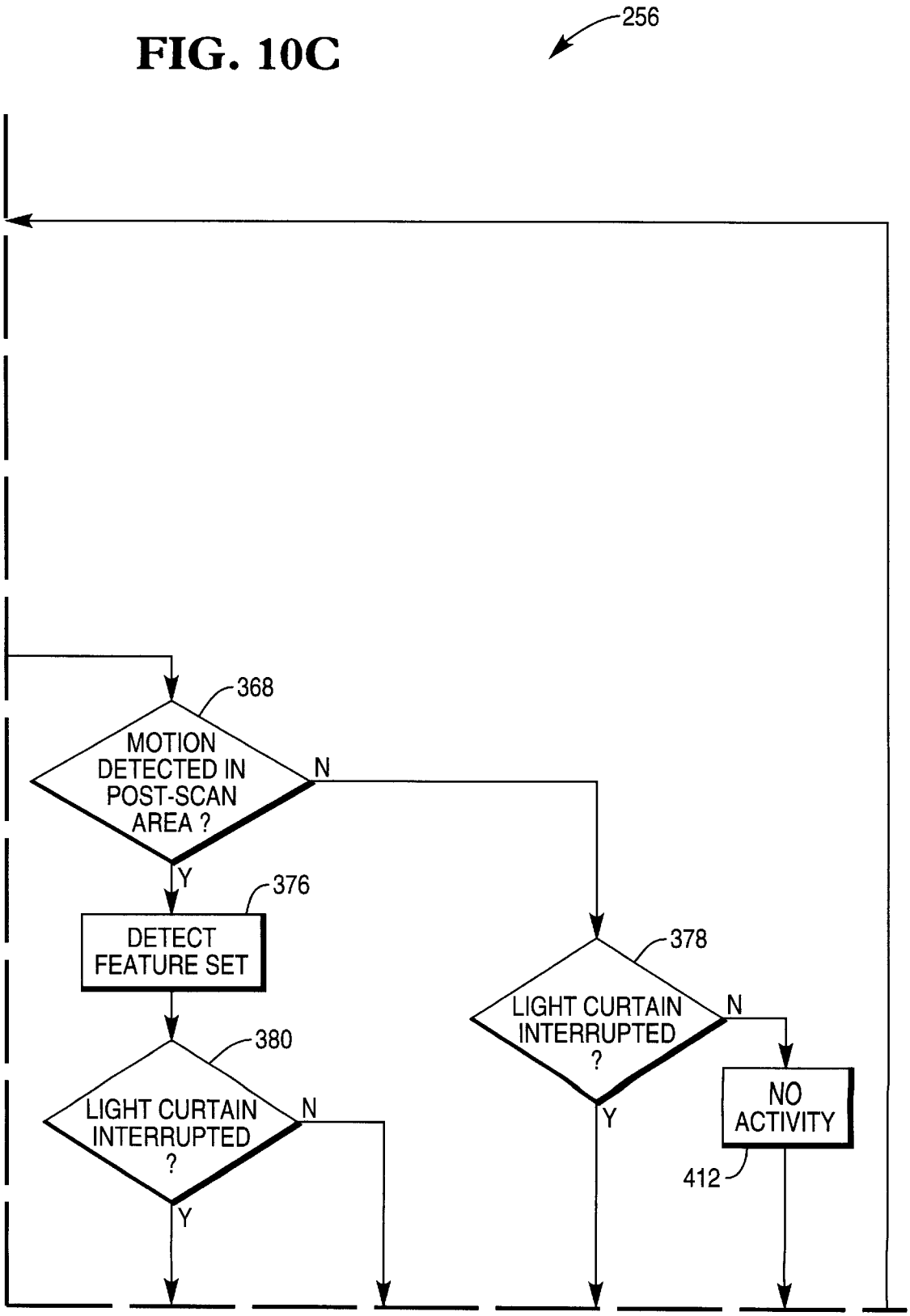
Figures 10, 10D:
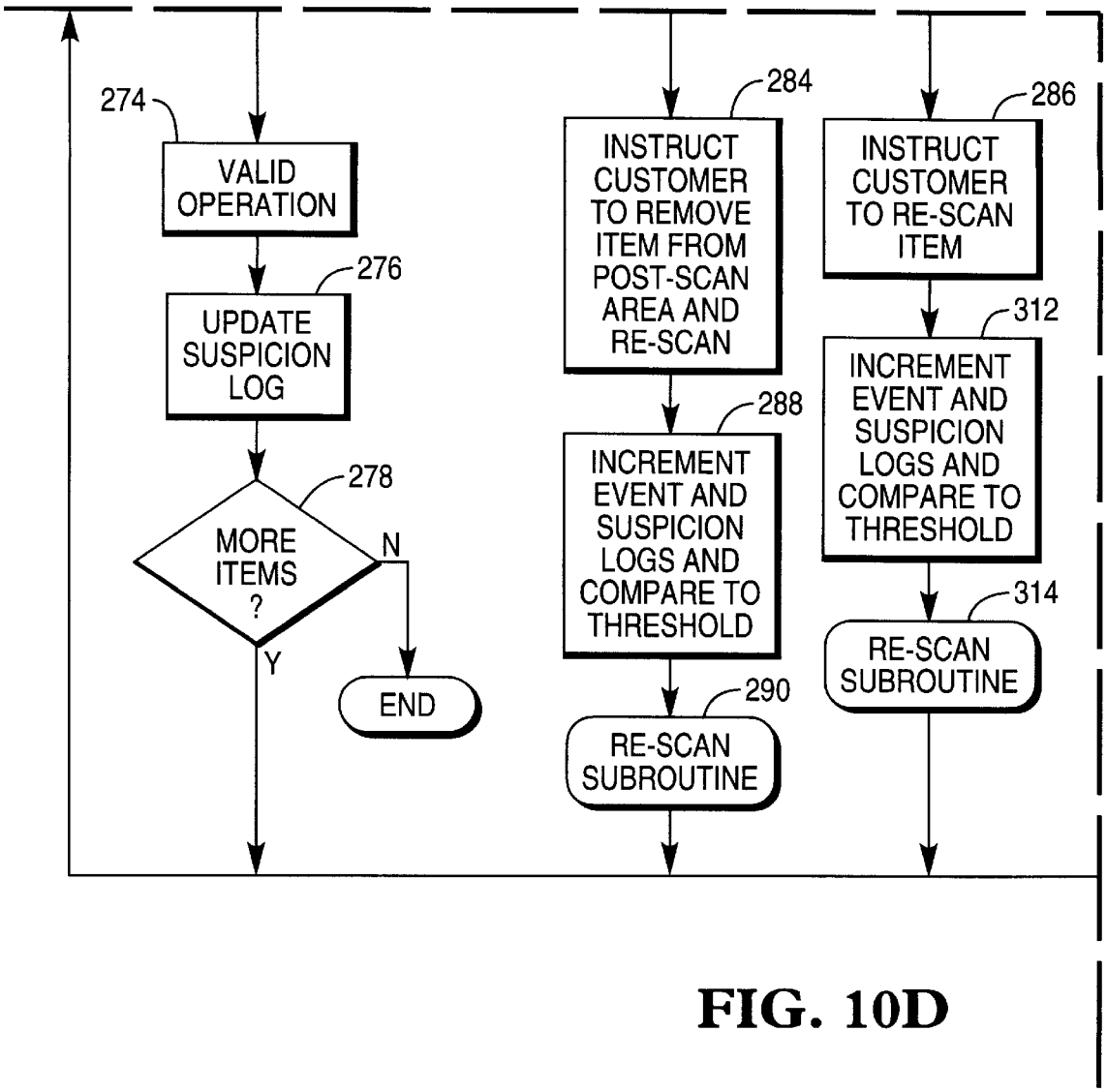
Figure 10E:
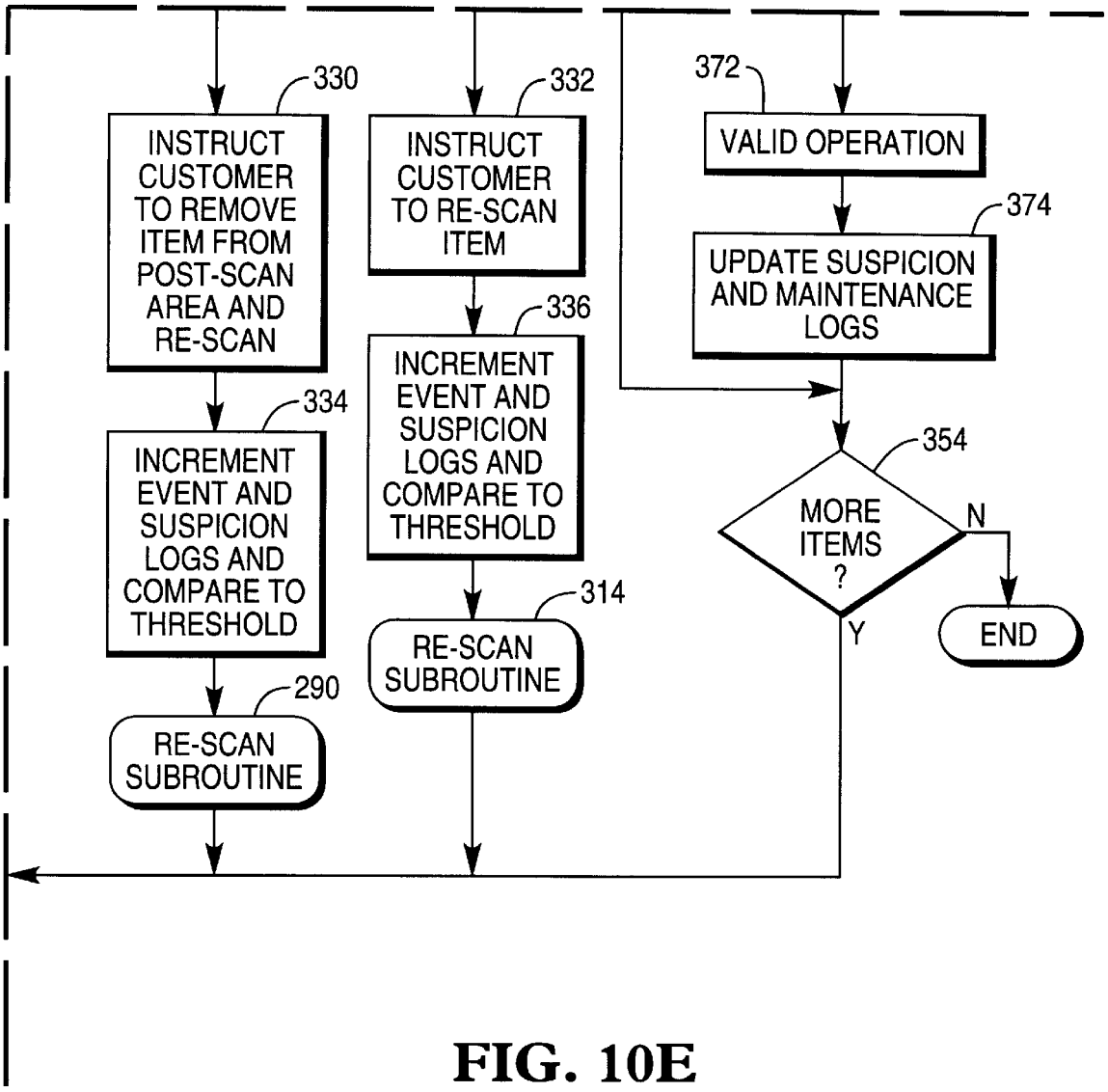
Figure 10F:
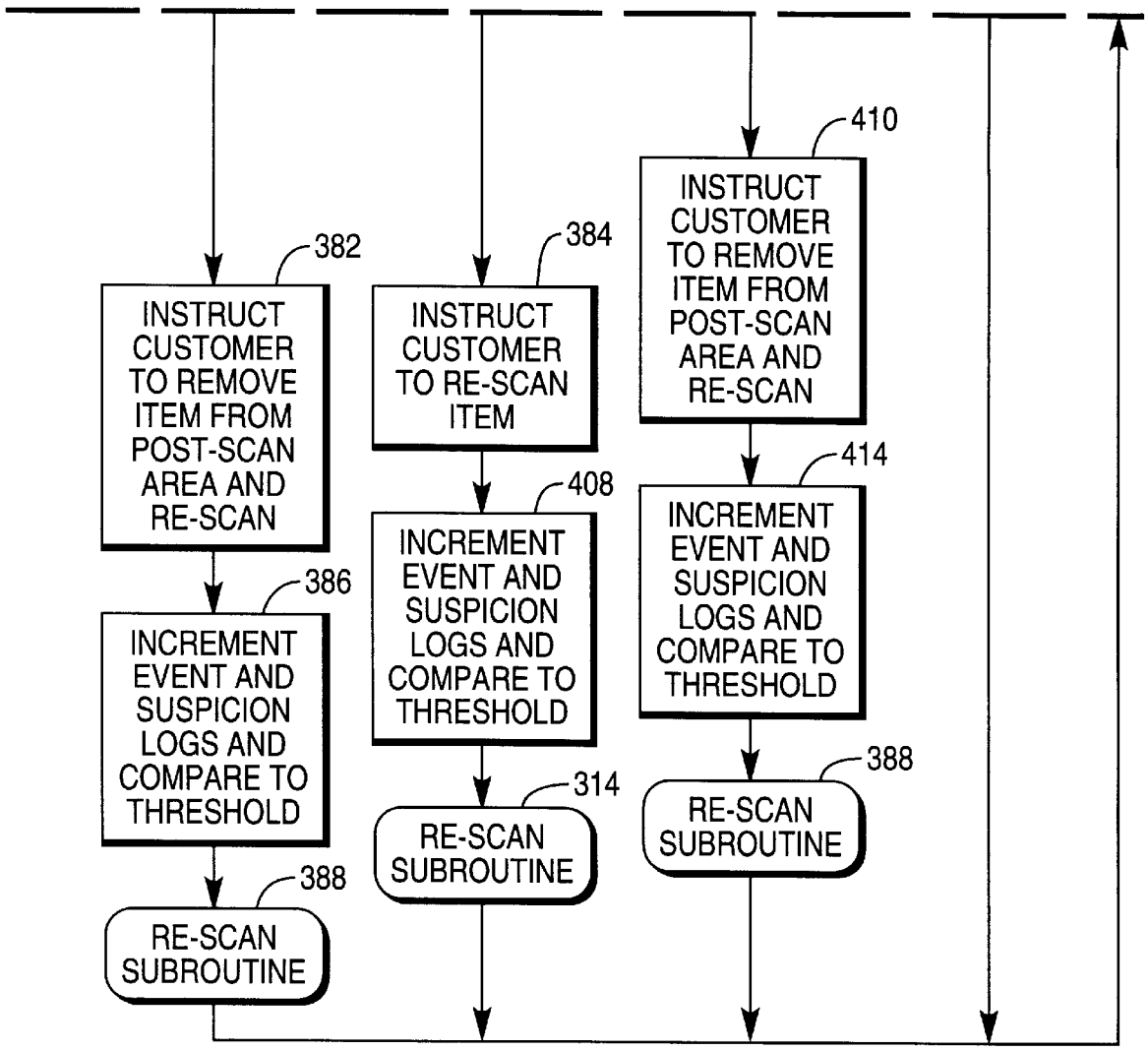

Referring now to FIG. 10, there is shown a flowchart of a second embodiment of the itemization step 56 which incorporates the use of the video system 16 having a third target area (i.e. a target area defined by the area proximate the post-scan area 27). The second embodiment of the itemization step 56 will hereinafter be designated with reference numeral 256. After the initialization step 54 (see FIG. 4) is completed, the routine 256 advances to step 260 where a message is displayed on the display monitor 18 which instructs the customer to pass or otherwise scan individual items across or adjacent the scanner 14 with the product identification code facing one of the scanning windows 14*a*, 14*b*.

The routine 256 then advances to step 262 where the processing unit 12 scans or reads the data communication line 42 to determine whether the video system 16 has detected the customer scanning an item across the target area associated with the scanner 14. In particular, the video system 16 generates an output signal which is sent to the processing unit 12 once the video system 16 detects the motion of the customer scanning the item across the scanner 14. If a scanning motion is detected, the routine 256 advances to step 263. If a scanning motion is not detected, the routine 256 advances to step 266.

In step 263, the processing unit 12 stores into a memory location associated therewith a file which includes a digital image of the feature set associated with the item that was passed across the scanner 14 in step 262. After the processing unit 12 determines the feature set associated with the item being scanned, the routine 256 advances to step 264.

In step 264, the processing unit 12 scans or reads the data communication line 40 to determine whether the scanner 14 has successfully read or otherwise captured the product identification code associated with the item. More specifically, the scanner 14 generates an output signal which is sent to the processing unit 12 once the scanner 14 successfully reads the product identification code associated with the item. If the code is successfully read from the item, an item-entered control signal is generated and the routine 256 advances to step 268. If the code is not successfully read from the item, the routine 256 advances to step 270.

In step 268, the processing unit 12 scans or reads the data communication line 42 to determine whether the video system 16 has detected the customer moving the scanned item across the target area associated with the post-scan area 27. In particular, the video system 16 generates an output signal which is sent to the processing unit 12 once the video system 16 detects the motion of the customer moving the scanned item across the post-scan area 27. After scanning an item, the customer may opt not to immediately move the item into the post-scan area 27. For example, if the customer scanned a pack of gum, the customer may opt to place the gum into his or her pocket instead of placing the gum in the post-scan area 27. Hence, whether or not the video system 16 generates an output signal in step 268, the routine 256 is advanced to step 272.

In step 272, the processing unit 12 determines if the scanned item is placed in the post-scan area 27. More specifically, the light curtain device 24 generates an output or detection signal which is sent to the processing unit 12 once the light curtain 25 has been interrupted by the customer placing the scanned item in the post-scan area 27. As mentioned above, after scanning an item, the customer may opt not to immediately place the item in the post-scan area 27 (e.g. placing the gum in his or her pocket instead of the post-scan area 27). Hence, whether or not the light curtain device 24 generates an output signal in step 272, the routine 256 is advanced to step 274.

In step 274, the processing unit 12 determines that a successful checkout operation has been completed for the particular item selected for purchase. More specifically, the processing unit 12 concludes that the customer apparently scanned an item over the scanner 14 because the video system 16 generated an output signal on data communication line 42, and that the item was in fact scanned because the scanner 14 generated an output signal on the data communication line 40. The processing unit 12 may then communicate with the network 28 to obtain the price of the properly scanned item for use in generating a bill or receipt at the end of the checkout procedure. A valid-use control signal is generated and the routine 256 then advances to step 276.

In step 276, the processing unit updates the suspicion log. In particular, the processing unit 12 queries the memory device 30 to determine if the item that was successfully scanned in step 264 had previously been unsuccessfully scanned. If the customer has not previously attempted to scan the item that was successfully scanned in step 264, no change is made to the suspicion log. However, if the customer has previously tried to scan the item that was successfully scanned in step 264, the processing unit 12 determines what change, if any, should be made to the suspicion log. In particular, if the processing unit 12 determines that the item that was successfully scanned in step 264 was previously scanned unsuccessfully in an alpha-type event, the processing unit 12 causes the suspicion log to be decreased by a predetermined value such as ½. However, if the processing unit 12 determines that the item that was successfully scanned in step 264 was previously scanned unsuccessfully in a beta-type event, the processing unit 12 does not change the value of the suspicion log. The routine 256 then advances to step 278.

In step 278, the processing unit 12 monitors the communication line 49 from the data input device 20, the communication line 44 from the display monitor 18, the communication line 42 from the video system 16, and the communication line 40 from the scanner 14 in order to determine whether there are more items to be scanned. In particular, a message is displayed on the display monitor 18 instructing the customer to touch a particular touch screen area displayed on the display monitor 18, or to touch a particular key associated with the data input device 20, when the customer has completed scanning all of the items for purchase.

If a particular signal is detected on either of the communication lines 44 or 49, the processing unit 12 determines that the checkout procedure is complete and the routine 256 advances to the finalization step 58 (see FIG. 4). If a signal is detected on either one or both of the communication lines 42, 40, the processing unit 12 determines that the customer is attempting to scan another item for purchase, and the routine 256 advances to step 262.

Returning to step 264, if the product identification code was not successfully read from the item being scanned, the routine 256 advances to step 270. Step 270 follows the same procedure outlined above with regard to step 268. In particular, the processing unit 12 scans or reads the data communication line 42 to determine whether the video system 16 has detected the customer moving the unsuccessfully scanned item across the target area associated with the post-scan area 27. In particular, the video system 16 generates an output signal which is sent to the processing unit 12 once the video system 16 detects the motion of the customer moving the unsuccessfully scanned item across the post-scan area 27. If the unsuccessfully scanned item is moved across the target area associated with the post-scan area 27, the routine 256 advances to step 280. If the unsuccessfully scanned item is not moved across the target area associated with the post-scan area 27, the routine 256 advances to step 282.

In step 280, the processing unit 12 determines if the unsuccessfully scanned item is placed in the post-scan area 27. More specifically, the light curtain device 24 generates an output or detection signal which is sent to the processing unit 12 once the light curtain 25 has been interrupted by the customer placing the unsuccessfully scanned item in the post-scan area 27. If the unsuccessfully scanned item is placed in the post-scan area 27, an invalid-use control signal is generated and the routine 256 advances to step 284. If the unsuccessfully scanned item is not placed in the post-scan area 27, the routine advances to step 286.

In step 284, the processing unit 12 causes a message to be displayed on the display monitor 18 which instructs the customer to remove the item from the post-scan area 27, and thereafter re-scan the item. The routine 256 then advances to step 288.

In step 288, the processing unit 12 increments the event log and the suspicion log by a predetermined value. More specifically, the processing unit 12 generates an output signal which is sent to the memory device 30 which causes the event log and the suspicion log to be incremented in the memory device 30 by a value of one.

Thereafter, the processing unit 12 determines if the total value of either the event log or the suspicion log exceeds the respective predetermined threshold value for each log. More specifically, if the event log exceeds its predetermined threshold value, the processing unit 12 causes an output signal to be sent to the network 28 which in turn pages or otherwise summons the retailer's personnel in order to assist the customer. In addition, if the suspicion log exceeds its predetermined threshold value, the processing unit 12 causes an output signal to be sent to the network 28 which in turn pages or otherwise summons the retailer's personnel such as security personnel to audit or otherwise investigate the customer's transaction. The routine 256 then advances to a re-scan subroutine 290.

Figure 11:
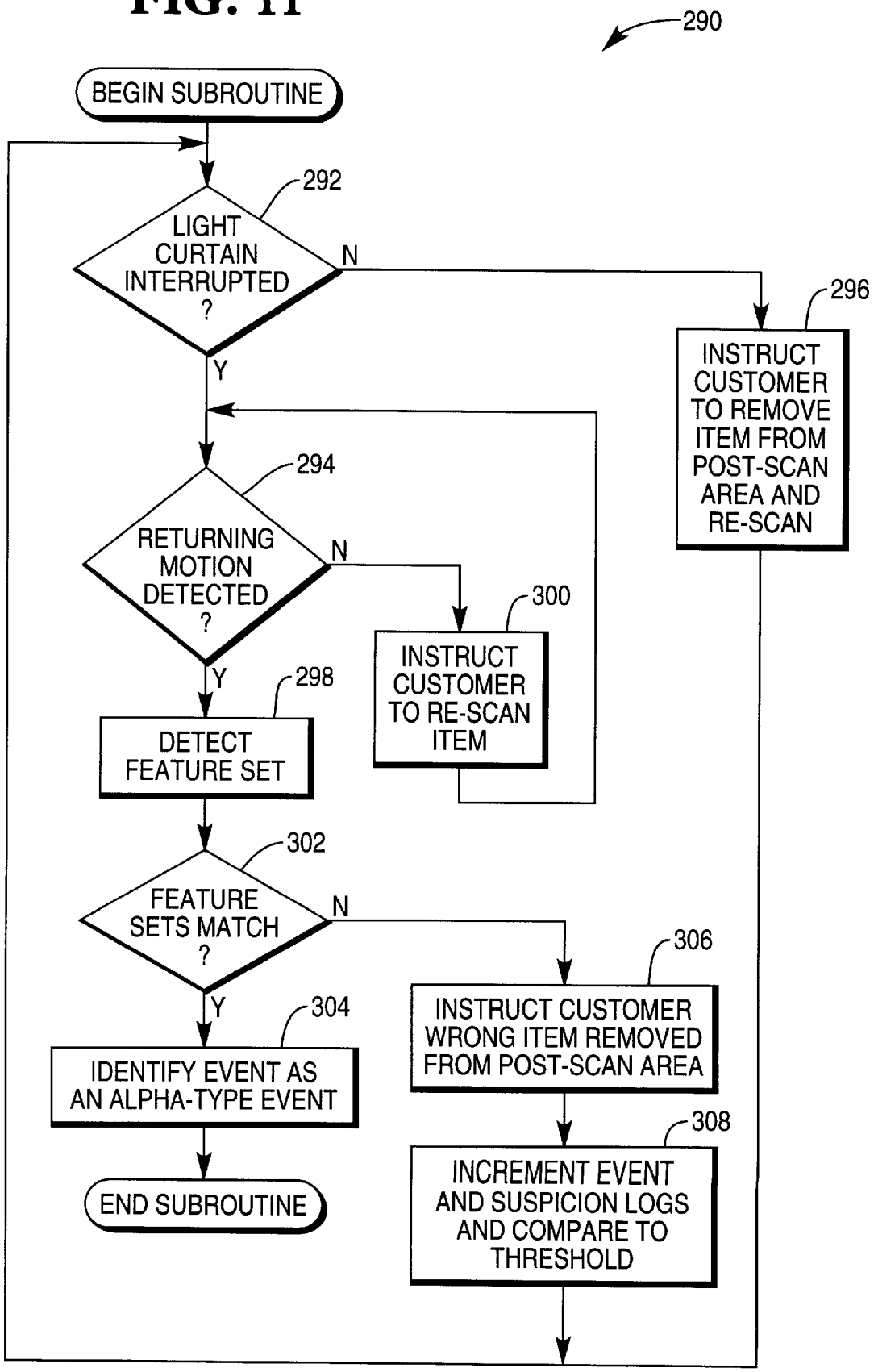
FIG. 11 is a flowchart setting forth in detail the re-scan subroutine 290 of the itemization step of FIG. 10.

Referring now to FIG. 11, there is shown a flow chart setting forth the re-scan subroutine 290 in greater detail. After completion of step 288 (see FIG. 10), the subroutine 290 advances to step 292. In step 292, the processing unit 12 determines if the customer removed the unsuccessfully scanned item from the post-scan area 27 as instructed. More specifically, the light curtain device 24 generates an output or removal signal which is sent to the processing unit 12 once the light curtain 25 has been interrupted thereby indicating that the customer removed the unsuccessfully scanned item from the post-scan area 27. If the unsuccessfully scanned item is removed from the post-scan area 27, the subroutine 290 advances to step 294. If the unsuccessfully scanned item is not removed from the post-scan area 27, the subroutine 290 advances to step 296.

In step 294, the processing unit 12 scans or reads the data communication line 42 to determine whether the video system 16 has detected motion associated with the customer moving the unsuccessfully scanned item across the target area of the scanner 14 in a direction which is opposite to the direction that the customer would move the item if the customer was attempting to scan the item. It should be appreciated that such motion is indicative of the customer returning the item to the area proximate the scanner 14 for a subsequent scanning attempt.

The video system 16 generates an output signal which is sent to the processing unit 12 once the video system 16 has detected the customer returning the unsuccessfully scanned item to the area proximate the scanner 14. If the unsuccessfully scanned item is returned to the area proximate the scanner 14, the subroutine 290 advances to step 298. If the unsuccessfully scanned item is not returned to the area proximate the scanner 14, the subroutine 290 advances to step 300.

In step 298, the processing unit 12 stores into a memory location associated therewith a file which includes a digital image of the feature set associated with the item that was returned across the area proximate scanner 14 in step 294. After the processing unit 12 determines the feature set associated with the item being returned, the subroutine 290 advances to step 302.

In step 302, the processing unit 12 determines if the feature set of the item that was removed from the post-scan area 27 matches the feature set of the item that was placed in the post-scan area 27. In particular, in step 302 the processing unit 12 compares the electronic file of the feature set of the item that was removed from the post-scan area 27 (as detected in step 298) with the electronic file of the feature set of the item that was placed in the post-scan area 27 (as detected in step 263 of FIG. 10). If the feature set of the item being removed from the post-scan area 27 matches the feature set of the item that was placed into the post scan area 27, a match control signal is generated and the subroutine 290 advances to step 304. If the feature set of the item being removed from the post-scan area 27 does not match the feature set of the item that was placed into the post-scan area 27, a mismatch control signal is generated and the subroutine 290 advances to step 306.

In step 304, the processing unit 12 determines that the customer has successfully removed the proper item from the post-scan area 27 in order to re-scan the item. In particular, the processing unit 12 concludes that (1) the customer removed an item from the post-scan area 27 (step 292), (2) the customer returned the item to the area proximate the scanner 14 (step 294), and (3) the feature set of the item removed from the post-scan area 27 matches the feature set of the item placed in the post-scan area 27 (step 302).

Further in step 304, the processing unit 12 determines that (1) there is a relatively low probability that the customer intentionally caused the item not to be scanned in step 264 (see FIG. 10), and (2) the customer properly removed the correct item for a subsequent re-scan attempt. Therefore, the processing unit identifies the event as an alpha-type event. More specifically, the processing unit 12 generates an output signal which is sent to the memory device 30 which identifies the event as an alpha-type event. Therefore, if the item is subsequently scanned correctly, the suspicion log will be decreased by a predetermined value as discussed above in regard to step 276. The subroutine 290 then ends thereby returning to step 262 of the routine 256 to monitor the re-scanning attempt of the item.

Returning now to step 302, if the feature set of the item removed from the post-scan area 27 does not match the feature set of the item that was placed in the post-scan area 27, a mismatch control signal is generated and the subroutine 290 advances to step 306. In step 306, the processing unit 12 causes a message to be displayed on the display monitor 18 which instructs the customer that the wrong item was removed from the post-scan area 27, and that the correct item should be removed from the post-scan area 27 for re-scanning. The subroutine 290 then advances to step 308.

In step 308, the processing unit 12 increments the event log and the suspicion log by a predetermined value. More specifically, the processing unit 12 generates an output signal which is sent to the memory device 30 which causes the event log and the suspicion log to be incremented in the memory device 30 by a value of one.

Thereafter, the processing unit 12 determines if the total value of either the event log or the suspicion log exceeds the respective predetermined threshold value for each log. More specifically, if the event log exceeds its predetermined threshold value, the processing unit 12 causes an output signal to be sent to the network 28 which in turn pages or otherwise summons the retailer's personnel in order to assist the customer. In addition, if the suspicion log exceeds its predetermined threshold value, the processing unit 12 causes an output signal to be sent to the network 28 which in turn pages or otherwise summons the retailer's personnel such as security personnel to audit or otherwise investigate the customer's transaction. If neither the event log nor the suspicion log exceeds its respective threshold value, the subroutine 290 then advances to step 292 to monitor the removal of a subsequent item from the post-scan area 27.

Returning now to step 294, if the unsuccessfully scanned item is not returned to the area proximate the scanner 14 within a reasonable period of time, the subroutine 290 advances to step 300. In step 300, the processing unit 12 causes a message to be displayed on the display monitor 18 which re-instructs the customer to re-scan the item which was removed from the post-scan area 27. The subroutine 290 then loops back to step 294.

Returning now to step 292, if the unsuccessfully scanned item is not removed from the post-scan area 27 within a reasonable period of time, the subroutine 290 advances to step 296. In step 296, the processing unit 12 causes a message to be displayed on the display monitor 18 which re-instructs the customer to remove the item from the post-scan area 27. The subroutine 290 then loops back to step 292.

Returning now to step 280 of the routine 256 (see FIG. 10), if the unsuccessfully scanned item is not placed in the post-scan area 27, the routine 256 advances to step 286. In step 286, the processing unit 12 causes a message to be displayed on the display monitor 18 which instructs the customer to re-scan the item. The routine 256 then advances to step 312.

Step 312 follows the same general procedure outlined above in regard to step 288. In particular, the processing unit 12 increments the event log and the suspicion log by a predetermined value. More specifically, the processing unit 12 generates an output signal which is sent to the memory device 30 which causes the event log and the suspicion log to be incremented in the memory device 30 by a value of one.

Thereafter, the processing unit 12 determines if the total value of either the event log or the suspicion log exceeds the respective predetermined threshold value for each log. More specifically, if the event log exceeds its predetermined threshold value, the processing unit 12 causes an output signal to be sent to the network 28 which in turn pages or otherwise summons the retailer's personnel in order to assist the customer. In addition, if the suspicion log exceeds its predetermined threshold value, the processing unit 12 causes an output signal to be sent to the network 28 which in turn pages or otherwise summons the retailer's personnel such as security personnel to audit or otherwise investigate the customer's transaction. If neither the event log nor the suspicion log exceeds its respective threshold value, the routine 256 then advances to a re-scan subroutine 314.

Figure 12:
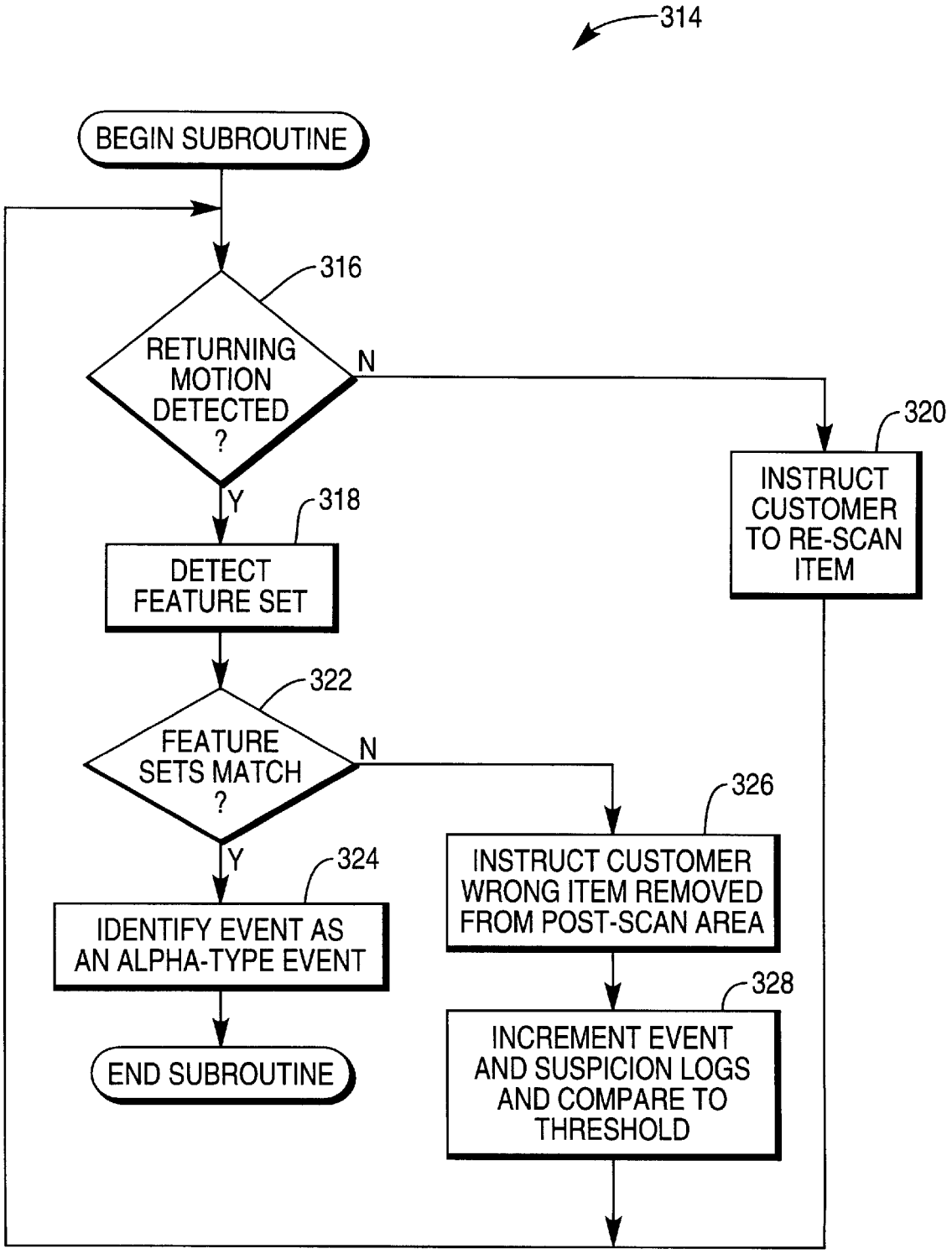
FIG. 12 is a flowchart setting forth in detail the re-scan subroutine 314 of the itemization step of FIG. 10.

Referring now to FIG. 12, there is shown a flow chart setting forth the re-scan subroutine 314 in greater detail. After completion of step 312 (see FIG. 10), the subroutine 314 advances to step 316. In step 316, the processing unit 12 scans or reads the data communication line 42 to determine whether the video system 16 has detected motion associated with the customer moving the unsuccessfully scanned item across the target area of the scanner 14 in a direction which is opposite to the direction that the customer would move the item if the customer was attempting to scan the item. It should be appreciated that such motion is indicative of the customer returning the item to the area proximate the scanner 14 for a subsequent scanning attempt.

The video system 16 generates an output signal which is sent to the processing unit 12 once the video system 16 has detected the customer returning the unsuccessfully scanned item to the area proximate the scanner 14. If the unsuccessfully scanned item is returned to the area proximate the scanner 14, the subroutine 314 advances to step 318. If the unsuccessfully scanned item is not returned to the area proximate the scanner 14, the subroutine 314 advances to step 320.

In step 318, the processing unit 12 stores into a memory location associated therewith a file which includes a digital image of the feature set associated with the item that was returned across the area proximate scanner 14 in step 316. After the processing unit 12 determines the feature set associated with the item being returned, the subroutine 314 advances to step 322.

In step 322, the processing unit 12 determines if the feature set of the item returned to the area proximate the scanner 14 matches the feature set of the item that was unsuccessfully scanned. In particular, the processing unit 12 compares the electronic file of the feature set of the item that was returned to the area proximate the scanner 14 (as detected in step 318) with the electronic file of the feature set of the item which was unsuccessfully scanned (as detected in step 263 of FIG. 10). If the feature set of the item being returned to the area proximate the scanner 14 matches the feature set of the item that was unsuccessfully scanned, a match control signal is generated and the subroutine 314 advances to step 324. If the feature set of the item being returned to the area proximate the scanner 14 does not match the feature set of the item that was unsuccessfully scanned, a mismatch control signal is generated and the subroutine 314 advances to step 326.

In step 324, the processing unit 12 determines that the customer has successfully returned the proper item to the area proximate the scanner 14 in order to re-scan the item. In particular, the processing unit 12 concludes that (1) the customer returned the item to the area proximate the scanner 14 (step 316), and (2) the feature set of the item returned to the area proximate the scanner 14 matches the feature set of the item which was unsuccessfully scanned (step 322).

The processing unit 12 determines that (1) there is a relatively low probability that the customer intentionally caused the item not to be scanned in step 264 (see FIG. 10), and (2) the customer properly returned the correct item for a subsequent re-scan attempt. Therefore, the processing unit identifies the event as an alpha-type event. More specifically, the processing unit 12 generates an output signal which is sent to the memory device 30 which identifies the event as an alpha-type event. Therefore, if the item is subsequently scanned correctly, the suspicion log will be decreased by a predetermined value as discussed above in regard to step 276. The subroutine 314 then ends thereby returning to step 262 of the routine 256 to monitor the re-scanning attempt of the item.

Returning now to step 322, if the feature set of the item returned to the area proximate the scanner 14 does not match the feature set of the item that was unsuccessfully scanned, a mismatch control signal is generated and the subroutine 314 advances to step 326. In step 326, the processing unit 12 causes a message to be displayed on the display monitor 18 which instructs the customer that the wrong item was returned to the area proximate the scanner 14 and that the correct item should be returned to the area proximate the scanner 14 for re-scanning. The subroutine 314 then advances to step 328.

In step 328, the processing unit 12 increments the event log and the suspicion log by a predetermined value. More specifically, the processing unit 12 generates an output signal which is sent to the memory device 30 which causes the event log and the suspicion log to be incremented in the memory device 30 by a value of one.

Thereafter, the processing unit 12 determines if the total value of either the event log or the suspicion log exceeds the respective predetermined threshold value for each log. More specifically, if the event log exceeds its predetermined threshold value, the processing unit 12 causes an output signal to be sent to the network 28 which in turn pages or otherwise summons the retailer's personnel in order to assist the customer. In addition, if the suspicion log exceeds its predetermined threshold value, the processing unit 12 causes an output signal to be sent to the network 28 which in turn pages or otherwise summons the retailer's personnel such as security personnel to audit or otherwise investigate the customer's transaction. If neither the event log nor the suspicion log exceeds its respective threshold value, the subroutine 314 then advances to step 316 to monitor the return of a subsequent item to the area proximate the scanner 14.

Returning now to step 316, if the unsuccessfully scanned item is not returned to the area proximate the scanner 14 within a reasonable period of time, the subroutine 314 advances to step 320. In step 320, the processing unit 12 causes a message to be displayed on the display monitor 18 which re-instructs the customer to re-scan the item. The subroutine 314 then loops back to step 316.

Returning now to step 270 of the routine 256 (see FIG. 10), if the unsuccessfully scanned item is not moved across the target area associated with the post-scan area 27, the routine 256 advances to step 282. In step 282, the processing unit 12 determines if the unsuccessfully scanned item is placed in the post-scan area 27. More specifically, the light curtain device 24 generates an output or detection signal which is sent to the processing unit 12 once the light curtain 25 has been interrupted by the customer placing the unsuccessfully scanned item in the post-scan area 27. If the unsuccessfully scanned item is placed in the post-scan area 27, an invalid-use control signal is generated and the routine 256 advances to step 330. If the unsuccessfully scanned item is not placed in the post-scan area 27, the routine advances to step 332.

In step 330, the processing unit 12 causes a message to be displayed on the display monitor 18 which instructs the customer to remove the item from the post-scan area 27, and thereafter re-scan the item. The routine 256 then advances to step 334.

In step 334, the processing unit 12 increments the event log and the suspicion log by a predetermined value. More specifically, the processing unit 12 generates an output signal which is sent to the memory device 30 which causes the event log and the suspicion log to be incremented in the memory device 30 by a value of one.

Thereafter, the processing unit 12 determines if the total value of either the event log or the suspicion log exceeds the respective redetermined threshold value for each log. More specifically, if the event log exceeds its predetermined threshold value, the processing unit 12 causes an output signal to be sent to the network 28 which in turn pages or otherwise summons the retailer's personnel in order to assist the customer. In addition, if the suspicion log exceeds its predetermined threshold value, the processing unit 12 causes an output signal to be sent to the network 28 which in turn pages or otherwise summons the retailer's personnel such as security personnel to audit or otherwise investigate the customer's transaction. The routine 256 then advances to the re-scan subroutine 290.

As discussed above, during execution of subroutine 290, the processing unit 12 communicates with the video system 16 and the light curtain device 24 thereby monitoring the customers removal of the unsuccessfully scanned item from the post-scan area 27 in order for the item to be subsequently re-scanned. No further discussion of the subroutine 290 is warranted.

Returning now to step 282 of the routine 256 (see FIG. 10), if the unsuccessfully scanned item is not moved across the target area associated with the post-scan area 27, the routine 256 advances to step 332. In step 332, the processing unit 12 causes a message to be displayed on the display monitor 18 which instructs the customer to re-scan the item. The routine 256 then advances to step 336.

Step 336 follows the same general procedure outlined above in regard to step 312. In particular, the processing unit 12 increments the event log and the suspicion log by a predetermined value. More specifically, the processing unit 12 generates an output signal which is sent to the memory device 30 which causes the event log and the suspicion log to be incremented in the memory device 30 by a value of one.

Thereafter, the processing unit 12 determines if the total value of either the event log or the suspicion log exceeds the respective predetermined threshold value for each log. More specifically, if the event log exceeds its predetermined threshold value, the processing unit 12 causes an output signal to be sent to the network 28 which in turn pages or otherwise summons the retailer's personnel in order to assist the customer. In addition, if the suspicion log exceeds its predetermined threshold value, the processing unit 12 causes an output signal to be sent to the network 28 which in turn pages or otherwise summons the retailers personnel such as security personnel to audit or otherwise investigate the customer's transaction. If neither the event log nor the suspicion log exceeds its respective threshold value, the routine 256 then advances to the re-scan subroutine 314.

As discussed above, during execution of subroutine 314, the processing unit 12 communicates with the video system 16 thereby monitoring the customer's return of the unsuccessfully scanned item to the area proximate the scanner 14 in order for the item to be subsequently re-scanned. No further discussion of the subroutine 314 is warranted.

Returning to step 262 (see FIG. 10), if a scanning motion across the scanner 14 is not detected, the routine 256 advances to step 266. In step 266, the processing unit 12 scans or reads the data communication line 42 to determine whether the video system 16 has detected the customer placing an item on the product scale 22. In particular, the video system 16 generates an output signal which is sent to the processing unit 12 once the video system 16 detects the motion of the customer placing the item on the product scale 22. If an item is detected on the product scale 22, the routine 256 advances to a product weigh subroutine 338. If an item is not detected on the product scale 22, the routine 256 advances to step 340.

Figure 13A:
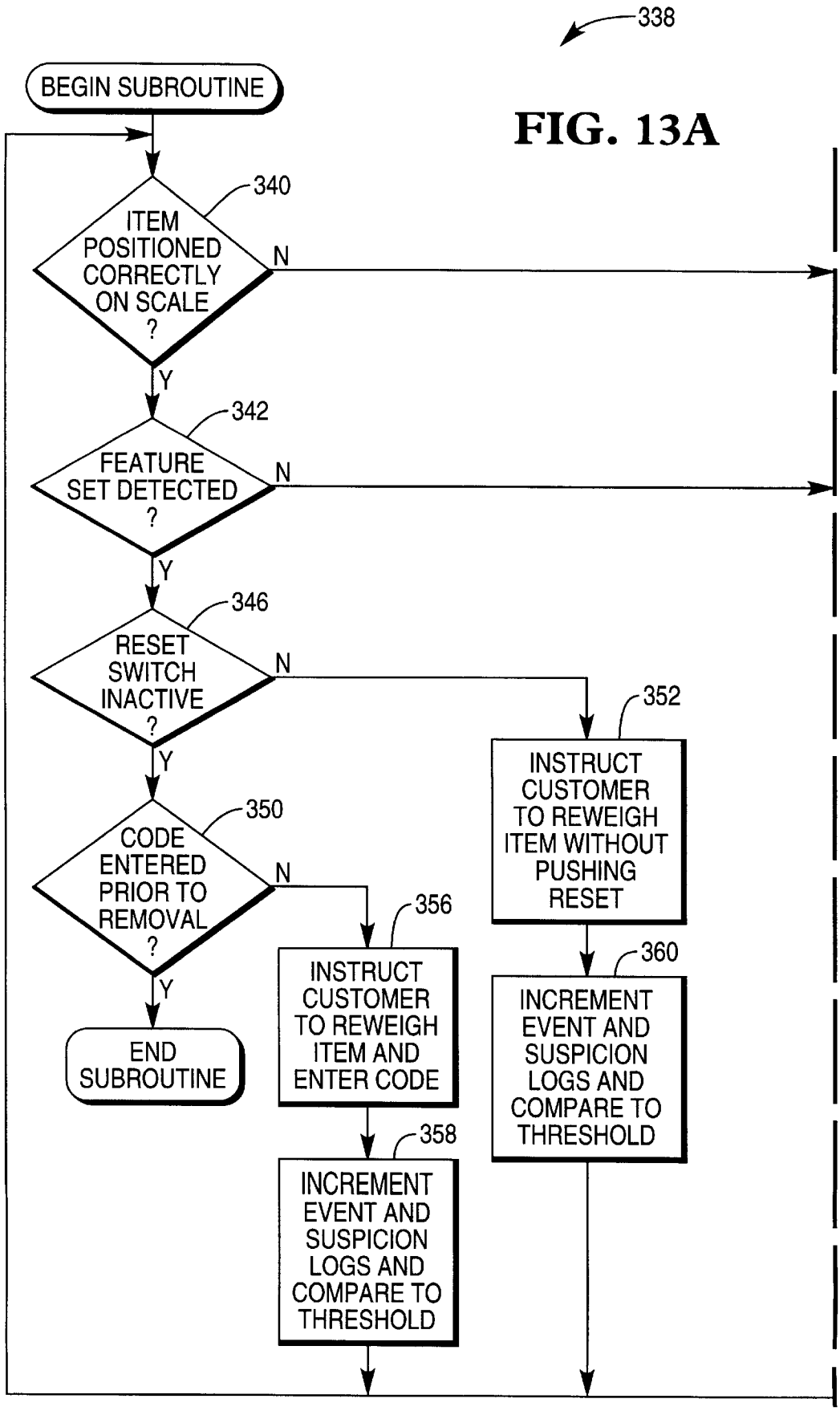
FIGS. 13A and 13B collectively comprise FIG. 13 which is a flowchart setting forth in detail the product weigh subroutine 338 of the itemization step of FIG. 10.
Figure 13B:
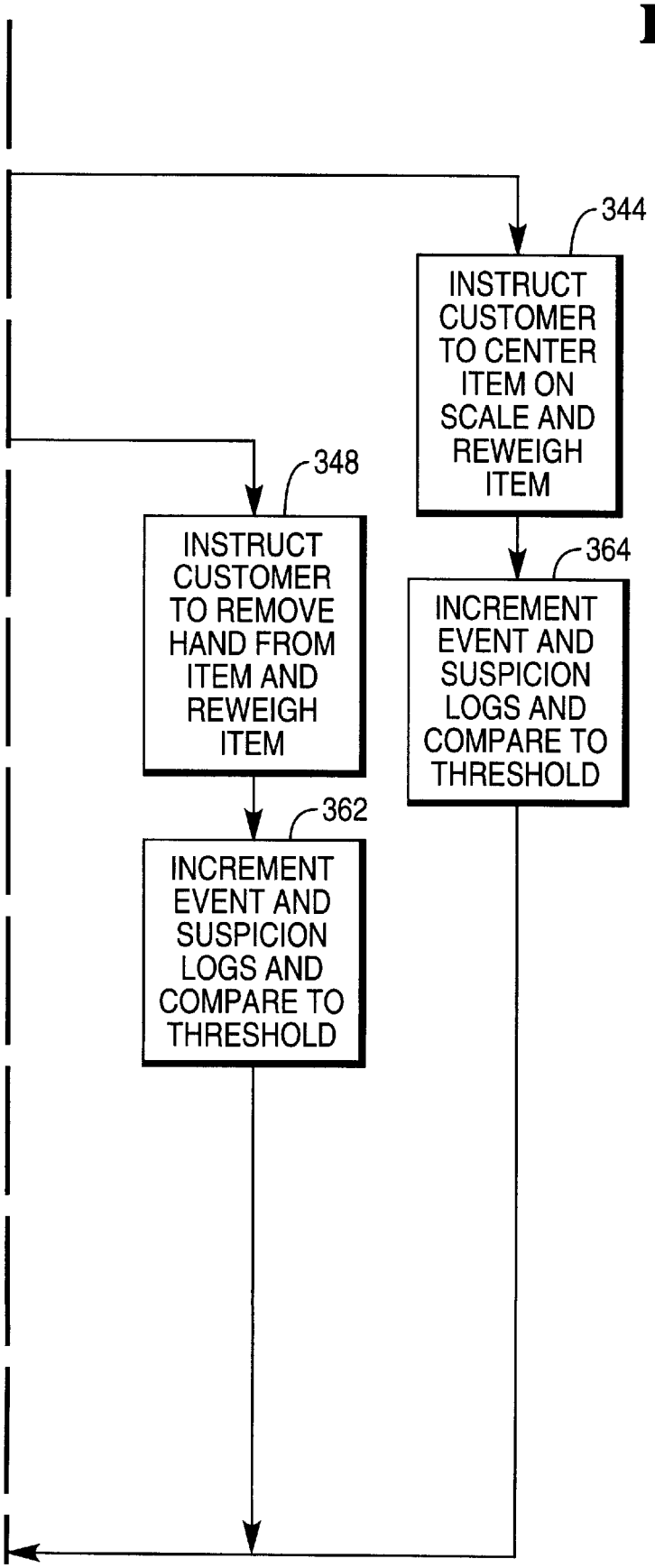

Referring now to FIG. 13, there is shown a flow chart setting forth the product weigh subroutine 338 in greater detail. After completion of step 266 (see FIG. 10), the subroutine 338 advances to step 340. In step 340, the processing unit 12 scans or reads the data communication line 42 to determine whether the video system 16 has detected that the customer has correctly positioned the item to be weighed on the product scale 22. In particular, since the product scale 22 is integrated with the scanner 14, the video system 16 determines if the entire item is positioned on the product scale 22 by determining if the entire item is within the target area of the scanner 14. It should be appreciated that if a portion of the item being weighed on the product scale 22 is not positioned on the product scale 22, the measured weight of the item may be erroneously low. If the item to be weighed is positioned correctly on the product scale 22, the subroutine 338 advances to step 342. If the item to be weighed is not positioned correctly on the product scale 22, the subroutine 338 advances to step 344.

In step 342, the processing unit 12 scans or reads the data communication line 42 to determine whether the video system 16 has detected the feature set associated with the item positioned on the product scale 22. It should be appreciated that the inability of the video system 16 to detect the feature set associated with the item positioned on the product scale 22 may be caused by the customer keeping his or her hand on the item as the product scale 22 attempts to weigh the item thereby potentially causing the measured weight of the item to be erroneously low. If the feature set associated with the item positioned on the product scale 22 is determined, the subroutine 338 advances to step 346. If the feature set associated with the item positioned on the product scale 22 is not determined, the subroutine 338 advances to step 348.

In step 346, the processing unit 12 scans or reads the data communication line 48 to determine whether a reset switch (not shown) associated with the product scale 22 has been pushed or otherwise activated by the customer. It should be appreciated that activation of the reset switch of the product scale 22 may cause the measured weight of the item to be erroneously low or even non-existent. If the reset switch is inactive or has otherwise not been pushed by the customer while the item is positioned on the product scale 22, the subroutine 338 advances to step 350. If the reset switch is pushed by the customer while the item is positioned on the product scale 22, the subroutine 338 advances to step 352.

In step 350, the processing unit 12 scans or otherwise reads the data communication line 49 to determine if the customer has properly input the product code associated with the item being weighed via the data input device 20 prior to removal of the item from the product scale 22. It should be appreciated that the processing unit 12 uses the product code to communicate with the network 28 to obtain the price of the properly weighed item for use in generating a bill or receipt at the end of the checkout procedure. If the product code associated with the item is properly entered via the data input device 20 prior to removal of the item from product scale 22, an item-entered control signal is generated and the subroutine 338 then ends thereby returning to step 354 in the routine 256 (see FIG. 10). If the product code associated with the item is not properly entered via the data input device 20 prior to removal of the item from the product scale 22, the subroutine 338 advances to step 356.

Step 354 (see FIG. 10) follows the same procedure outlined above in regard to step 278. In particular, the processing unit 12 monitors the communication line 49 from the data input device 20, the communication line 44 from the display monitor 18, the communication line 42 from the video system 16, and the communication line 40 from the scanner 14 in order to determine whether there are more items to be scanned. More specifically, a message is displayed on the display monitor 18 instructing the customer to touch a particular touch screen area displayed on the display monitor 18, or to touch a particular key associated with the data input device 20, when the customer has completed scanning all of the items for purchase.

If a particular signal is detected on either of the communication lines 44 or 49, the processing unit 12 determines that the checkout procedure is complete and the routine 256 advances to the finalization step 58 (see FIG. 4). If a signal is detected on either one or both of the communication lines 42, 40, the processing unit 12 determines that the customer is attempting to scan another item for purchase, and the routine 256 advances to step 262.

Returning now to step 350 (see FIG. 13), if the product code associated with the item being weighed is not properly entered via the data input device 20 prior to removal of the item from the product scale 22, the subroutine 338 advances to step 356. In step 356, the processing unit 12 causes a message to be displayed on the display monitor 18 which instructs the customer to reweigh the last item and enter a product code associated therewith. The subroutine 338 then advances to step 358.

In step 358, the processing unit 12 increments the event log and the suspicion log by a predetermined value. More specifically, the processing unit 12 generates an output signal which is sent to the memory device 30 which instructs the memory device 30 to increment both the event log and the suspicion log by a value of one.

Thereafter, the processing unit 12 determines if the total value of either the event log or the suspicion log exceeds the respective predetermined threshold value for each log. More specifically, if the event log exceeds its predetermined threshold value, the processing unit 12 causes an output signal to be sent to the network 28 which in turn pages or otherwise summons the retailer's personnel in order to assist the customer. In addition, if the suspicion log exceeds its predetermined threshold value, the processing unit 12 causes an output signal to be sent to the network 28 which in turn pages or otherwise summons the retailer's personnel such as security personnel to audit or otherwise investigate the customer's transaction. If neither the event log nor the suspicion log exceeds its respective threshold value, the subroutine 338 then advances to step 340 to monitor the customers attempt to reweigh the item.

Returning now to step 346, if the reset switch is pushed by the customer while the item is positioned on the product scale 22, the subroutine 338 advances to step 352. In step 352, the processing unit 12 causes a message to be displayed on the display monitor 18 which instructs the customer to reweigh the last item without pushing the reset switch. The subroutine 338 then advances to step 360.

Step 360 follows the same procedure outlined above in regard to step 358. In particular, the processing unit 12 increments the event log and the suspicion log by a predetermined value. More specifically, the processing unit 12 generates an output signal which is sent to the memory device 30 which instructs the memory device 30 to increment both the event log and the suspicion log by a value of one.

Thereafter, the processing unit 12 determines if the total value of either the event log or the suspicion log exceeds the respective predetermined threshold value for each log. More specifically, if the event log exceeds its predetermined threshold value, the processing unit 12 causes an output signal to be sent to the network 28 which in turn pages or otherwise summons the retailer s personnel in order to assist the customer. In addition, if the suspicion log exceeds its predetermined threshold value, the processing unit 12 causes an output signal to be sent to the network 28 which in turn pages or otherwise summons the retailer's personnel such as security personnel to audit or otherwise investigate the customer's transaction. If neither the event log nor the suspicion log exceeds its respective threshold value, the subroutine 338 then advances to step 340 to monitor the customer's attempt to reweigh the item.

Returning now to step 342, if the feature set associated with the item positioned on the product scale 22 is not determined, the subroutine 338 advances to step 348. In step 348, the processing unit 12 causes a message to be displayed on the display monitor 18 which instructs the customer to reweigh the last item without placing his or her hand on the item. The subroutine 338 then advances to step 362.

Step 362 follows the same procedure outlined above in regard to steps 358 and 360. In particular, the processing unit 12 increments the event log and the suspicion log by a predetermined value. More specifically, the processing unit 12 generates an output signal which is sent to the memory device 30 which instructs the memory device 30 to increment both the event log and the suspicion log by a value of one.

Thereafter, the processing unit 12 determines if the total value of either the event log or the suspicion log exceeds the respective predetermined threshold value for each log. More specifically, if the event log exceeds its predetermined threshold value, the processing unit 12 causes an output signal to be sent to the network 28 which in turn pages or otherwise summons the retailers personnel in order to assist the customer. In addition, if the suspicion log exceeds its predetermined threshold value, the processing unit 12 causes an output signal to be sent to the network 28 which in turn pages or otherwise summons the retailers personnel such as security personnel to audit or otherwise investigate the customer's transaction. If neither the event log nor the suspicion log exceeds its respective threshold value, the subroutine 338 then advances to step 340 to monitor the customer's attempt to reweigh the item.

Returning now to step 340, if the item to be weighed is not positioned correctly on the product scale 22, the subroutine 338 advances to step 344. In step 344, the processing unit 12 causes a message to be displayed on the display monitor 18 which instructs the customer to center the item on the product scale 22. The subroutine 338 then advances to step 364.

Step 364 follows the same procedure outlined above in regard to steps 358, 360, and 362. In particular, the processing unit 12 increments the event log and the suspicion log by a predetermined value. More specifically, the processing unit 12 generates an output signal which is sent to the memory device 30 which instructs the memory device 30 to increment both the event log and the suspicion log by a value of one.

Thereafter, the processing unit 12 determines if the total value of either the event log or the suspicion log exceeds the respective predetermined threshold value for each log. More specifically, if the event log exceeds its predetermined threshold value, the processing unit 12 causes an output signal to be sent to the network 28 which in turn pages or otherwise summons the retailers personnel in order to assist the customer. In addition, if the suspicion log exceeds its predetermined threshold value, the processing unit 12 causes an output signal to be sent to the network 28 which in turn pages or otherwise summons the retailers personnel such as security personnel to audit or otherwise investigate the customer's transaction. If neither the event log nor the suspicion log exceeds its respective threshold value, the subroutine 338 then advances to step 334 to monitor the customers attempt to reweigh the item.

Returning now to step 266 (see FIG. 10), if an item is not detected on the product scale 22, the routine 256 advances to step 340. Step 340 follows the same procedure outlined above with regard to step 264. In particular, the processing unit 12 scans or reads the data communication line 40 to determine whether the scanner 14 has successfully read or otherwise captured the bar code associated with the item. More specifically, the scanner 14 generates an output signal which is sent to the processing unit 12 once the scanner 14 successfully reads the product identification code off of the item. If the code is successfully read from the item, an item-entered control signal is generated and the routine 256 advances to step 366. If the code is not successfully read from the item, the routine 256 advances to step 368.

Step 366 follows the same procedure outlined above in regard to step 268. In particular, the video system 16 generates an output signal which is sent to the processing unit 12 once the video system 16 detects the motion of the customer moving the scanned item across the post-scan area 27. As discussed above, the customer may opt not to immediately move the item into the post-scan area 27. (e.g. the customer may opt to place a pack of gum into his or her pocket instead of placing the gum in the post-scan area 27). Hence, whether or not the video system 16 generates an output signal in step 366, the routine 256 is advanced to step 370.

In step 370, the processing unit 12 determines if the scanned item is placed in the post-scan area 27. More specifically, the light curtain device 24 generates an output or detection signal which is sent to the processing unit 12 once the light curtain 25 has been interrupted by the customer placing the item in the post-scan area 27. As discussed above, the customer may opt not to immediately place the item in the post-scan area 27 after scanning an item. Hence, whether or not the light curtain device 24 generates an output signal in step 370, the routine 256 is advanced to step 372.

In step 372, the processing unit 12 determines that a successful checkout operation has been completed for the particular item selected for purchase. More specifically, the processing unit 12 concludes that the customer apparently scanned an item over the scanner 14 because the scanner 14 generated an output signal on the data communication line 40. However, because the video system 16 did not generate an output signal on the data communication line 42 in step 262, the processing unit 12 concludes that the video system 16 may not be functioning properly. The processing unit 12 then communicates with the network 28 to obtain the price of the properly scanned item for use in generating a bill or receipt at the end of the checkout procedure. A valid-use control signal is generated and the routine 256 then advances to step 374.

In step 374, the processing unit updates the suspicion log. In particular, the processing unit 12 queries the memory device 30 to determine if the item that was successfully scanned in step 340 had previously been unsuccessfully scanned. If the customer has not previously attempted to scan the item that was successfully scanned in step 340, no change is made to the suspicion log. However, if the customer has previously attempted to scan the item which was successfully scanned in step 340, the processing unit 12 determines what change, if any, should be made to the suspicion log.

As discussed above, if the processing unit 12 determines that the item that was successfully scanned in step 340 was previously unsuccessfully scanned in an alpha-type event, the processing unit 12 causes the suspicion log to be decreased by a predetermined value such as ½. However, if the processing unit 12 determines that the item that was successfully scanned in step 340 was previously scanned unsuccessfully in a beta-type event, the processing unit 12 does not change the value of the suspicion log.

Since the processing unit 12 also determined that the video system 16 may not be functioning properly in step 372, the processing unit 12 increments the maintenance log thereby recording the potential malfunction of the video system 16. If the value of the maintenance log exceeds a predetermined threshold, an error message is sent across the network 28 by the processing unit 12 thereby requesting immediate maintenance attention. The routine 256 then advances to step 354.

As discussed above, in step 354 the processing unit 12 monitors the communication line 49 from the data input device 20, the communication line 44 from the display monitor 18, the communication line 42 from the video system 16, and the communication line 40 from the scanner 14 in order to determine whether there are more items to be scanned. In particular, a message is displayed on the display monitor 18 instructing the customer to touch a particular touch screen area displayed on the display monitor 18, or to touch a particular key associated with the data input device 20, when the customer has completed scanning all of the items for purchase.

If a particular signal is detected on either of the communication lines 44 or 49, the processing unit 12 determines that the checkout procedure is complete and the routine 256 advances to the finalization step 58 (see FIG. 4). If a signal is detected on either one or both of the communication lines 42, 40, the processing unit 12 determines that the customer is attempting to scan another item for purchase, and the routine advances to step 262.

Returning now to step 340, if the product identification code was not successfully read from the item being scanned, the routine 256 advances to step 368. Step 368 follows the same procedure outlined above with regard to step 270. More specifically, the processing unit 12 scans or reads the data communication line 42 to determine whether the video system 16 has detected the customer moving the unscanned item across the target area associated with the post-scan area 27. In particular, the video system 16 generates an output signal which is sent to the processing unit 12 once the video system 16 detects the motion of the customer moving the unscanned item across the post-scan area 27. If the unscanned item is moved across the target area associated with the post-scan area 27, the routine 256 advances to step 376. If the unscanned item is not moved across the target area associated with the post-scan area 27, the routine 256 advances to step 378.

In step 376, the processing unit 12 determines the feature set of the item that was moved across the post-scan area 27. More specifically, the video system 16 generates an output signal which is sent to the processing unit 12 once the video system 16 has determined the feature set of the item moved across the post-scan area 27. The routine 256 then advances to step 380.

Step 380 follows the same procedure outlined above in regard to step 280. In particular, the processing unit 12 determines if the unscanned item is placed in the post-scan area 27. More specifically, the light curtain device 24 generates an output or detection signal which is sent to the processing unit 12 once the light curtain 25 has been interrupted by the customer placing the unscanned item in the post-scan area 27. If the unscanned item is placed in the post-scan area 27, an invalid-use control signal is generated and the routine 256 advances to step 382. If the unscanned item is not placed in the post-scan area 27, the routine advances to step 384.

In step 382, the processing unit 12 causes a message to be displayed on the display monitor 18 which instructs the customer to remove the item from the post-scan area 27, and thereafter re-scan the item. The routine 256 then advances to step 386.

In step 386, the processing unit 12 increments the event log and the suspicion log by a predetermined value. More specifically, the processing unit 12 generates an output signal which is sent to the memory device 30 which causes the event log and the suspicion log to be incremented in the memory device 30 by a value of one.

Thereafter, the processing unit 12 determines if the total value of either the event log or the suspicion log exceeds the respective predetermined threshold value for each log. More specifically, if the event log exceeds its predetermined threshold value, the processing unit 12 causes an output signal to be sent to the network 28 which in turn pages or otherwise summons the retailer's personnel in order to assist the customer. In addition, if the suspicion log exceeds its predetermined threshold value, the processing unit 12 causes an output signal to be sent to the network 28 which in turn pages or otherwise summons the retailer's personnel such as security personnel to audit or otherwise investigate the customer's transaction. If neither the event log nor the suspicion log exceeds its respective threshold value, the routine 256 then advances to a re-scan subroutine 388.

Figure 14:
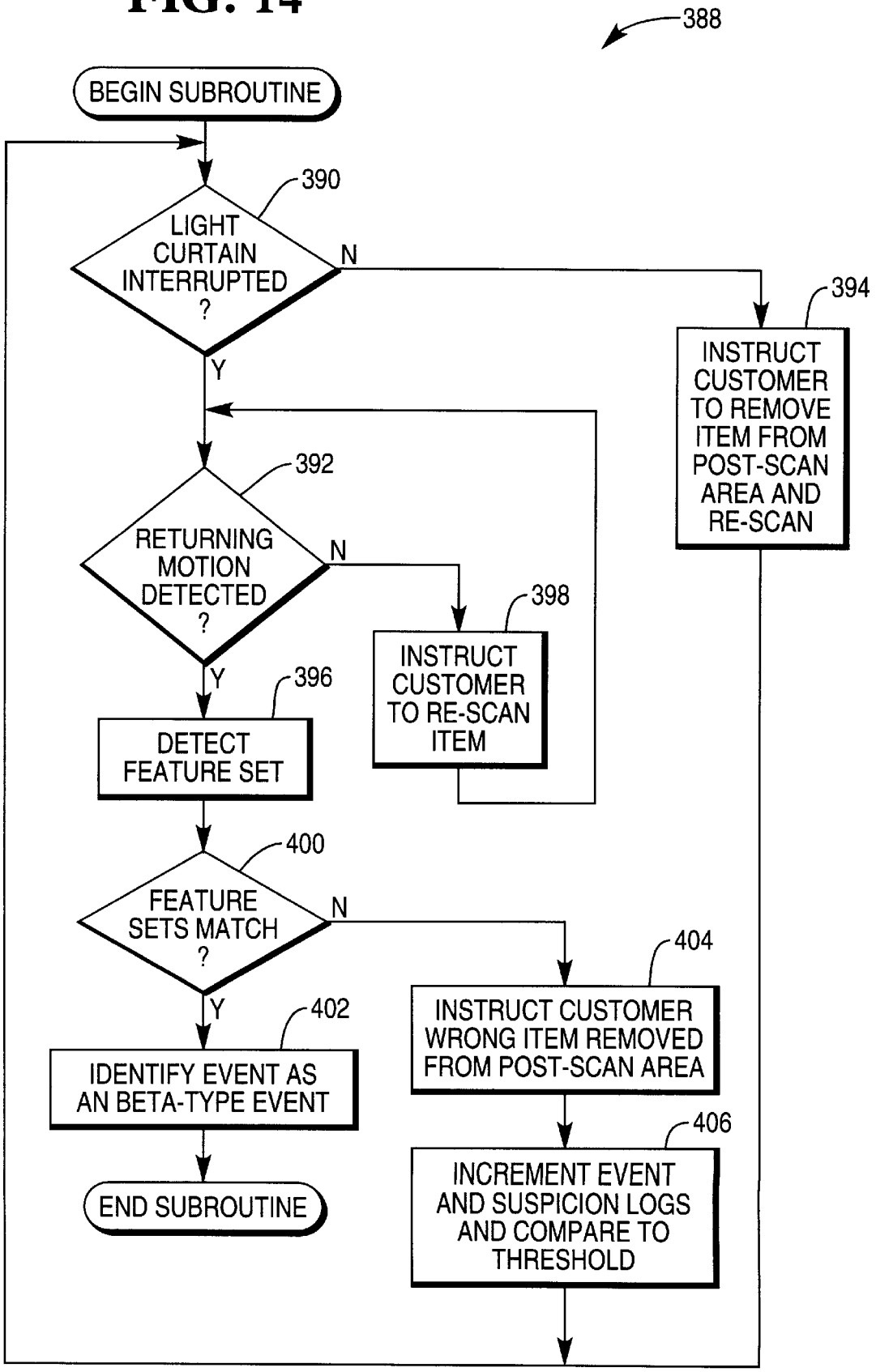
FIG. 14 is a flowchart setting forth in detail the re-scan subroutine 388 of the itemization step of FIG. 10.

Referring now to FIG. 14, there is shown a flow chart setting forth the re-scan subroutine 388 in greater detail. After completion of step 386 (see FIG. 10), the subroutine 388 advances to step 390. In step 390, the processing unit 12 determines if the customer removed the unscanned item from the post-scan area 27 as instructed. More specifically, the light curtain device 24 generates an output or removal signal which is sent to the processing unit 12 once the light curtain 25 has been interrupted thereby indicating that the customer removed the unscanned item from the post-scan area 27. If the unscanned item is removed from the post-scan area 27, the subroutine 388 advances to step 392. If the unscanned item is not removed from the post-scan area 27, the subroutine 388 advances to step 394.

In step 392, the processing unit 12 scans or reads the data communication line 42 to determine whether the video system 16 has detected motion associated with the customer moving the unscanned item across the target area of the scanner 14 in a direction which is opposite to the direction that the customer would move the item if the customer was attempting to scan the item. It should be appreciated that motion is indicative of the customer returning the item to the area proximate the scanner 14 for a subsequent scanning attempt.

The video system 16 generates an output signal which is sent to the processing unit 12 once the video system 16 has detected the customer returning the unscanned item to the area proximate the scanner 14. If the unscanned item is returned to the area proximate the scanner 14, the subroutine 388 advances to step 396. If the unscanned item is not returned to the area proximate the scanner 14, the subroutine 388 advances to step 398.

In step 396, the processing unit 12 stores into a memory location associated therewith a file which includes a digital image of the feature set associated with the item that was returned across the area proximate scanner 14 in step 392. After the processing unit 12 determines the feature set associated with the item being returned, the subroutine 388 advances to step 400.

In step 400, the processing unit 12 determines if the feature set of the item that was removed from the post-scan area 27 matches the feature set of the item that was placed in the post-scan area 27. In particular, the processing unit 12 compares the electronic file of the feature set of the item that was removed from the post-scan area 27 (as detected in step 396) with the electronic file of the feature set of the item that was placed in the post-scan area 27 (as detected in step 376 of FIG. 10). If the feature set of the item being removed from the post-scan area 27 matches the feature set of the item that was placed into the post-scan area 27, a match control signal is generated and the subroutine 388 advances to step 402. If the feature set of the item being removed from the post-scan area 27 does not match the feature set of the item that was placed into the post-scan area 27, a mismatch control signal is generated and the subroutine 388 advances to step 404.

In step 402, the processing unit 12 determines that the customer has successfully removed the proper item from the post-scan area 27 in order to re-scan the item. In particular, the processing unit 12 concludes that (1) the customer removed an item from the post-scan area 27 (step 390), (2) the customer returned the item to the area proximate the scanner 14 (step 392), and (3) the feature set of the item removed from the post-scan area 27 matches the feature set of the item placed in the post-scan area 27 (step 400).

Further in step 402, the processing unit 12 determines (1) there is a relatively high probability that the customer is attempting to commit an impropriety such as theft since (1) motion indicative of a scanning attempt was not detected in step 262 (see FIG. 10), (2) the item was in fact not scanned in step 340, and (3) the item was nonetheless placed in the post-scan area 27 in steps 368 and 380. Therefore, the processing unit 12 identifies the event as a beta-type event. More specifically, the processing unit 12 generates an output signal which is sent to the memory device 30 which identifies the event as a beta-type event. Therefore, even if the item is subsequently scanned correctly, the suspicion log will not be decreased. The subroutine 388 then ends thereby returning to step 262 of the routine 256 to monitor the re-scanning attempt of the item.

Returning now to step 400, if the feature set of the item removed from the post-scan area 27 does not match the feature set of the item that was placed in the post-scan area 27, a mismatch control signal is generated and the subroutine 388 advances to step 404. In step 404 the processing unit 12 causes a message to be displayed on the display monitor 18 which instructs the customer that the wrong item was removed from the post-scan area 27 and that the correct item should be removed from the post-scan area 27 for re-scanning. The subroutine 388 then advances to step 406.

In step 406, the processing unit 12 increments the event log and the suspicion log by a predetermined value. More specifically, the processing unit 12 generates an output signal which is sent to the memory device 30 which causes the event log and the suspicion log to be incremented in the memory device 30 by a value of one.

Thereafter, the processing unit 12 determines if the total value of either the event log or the suspicion log exceeds the respective predetermined threshold value for each log. More specifically, if the event log exceeds its predetermined threshold value, the processing unit 12 causes an output signal to be sent to the network 28 which in turn pages or otherwise summons the retailer's personnel in order to assist the customer. In addition, if the suspicion log exceeds its predetermined threshold value, the processing unit 12 causes an output signal to be sent to the network 28 which in turn pages or otherwise summons the retailer's personnel such as security personnel to audit or otherwise investigate the customer's transaction. If neither the event log nor the suspicion log exceeds its respective threshold value, the subroutine 388 then advances to step 390 to monitor the removal of a subsequent item from the post-scan area 27.

Returning now to step 392, if the unscanned item is not returned to the area proximate the scanner 14 within a reasonable period of time, the subroutine 388 advances to step 398. In step 398, the processing unit 12 causes a message to be displayed on the display monitor 18 which re-instructs the customer to re-scan the item which was removed from the post-scan area 27. The subroutine 388 then loops back to step 392.

Returning now to step 390, if the unscanned item is not removed from the post-scan area 27 within a reasonable period of time, the subroutine 388 advances to step 394. In step 394, the processing unit 12 causes a message to be displayed on the display monitor 18 which reinstructs the customer to remove the item from the post-scan area 27, and thereafter re-scan the item. The subroutine 388 then loops back to step 390.

Returning now to step 380 of the routine 256 (see FIG. 10), if the unscanned item is not placed in the post-scan area 27, the routine 256 advances to step 384. In step 384, the processing unit 12 causes a message to be displayed on the display monitor 18 which instructs the customer to re-scan the item. The routine 256 then advances to step 408.

Step 408 follows the same general procedure outlined above in regard to step 386. In particular, the processing unit 12 increments the event log and the suspicion log by a predetermined value. More specifically, the processing unit 12 generates an output signal which is sent to the memory device 30 which causes the event log and the suspicion log to be incremented in the memory device 30 by a value of one.

Thereafter, the processing unit 12 determines if the total value of either the event log or the suspicion log exceeds the respective predetermined threshold value for each log. More specifically, if the event log exceeds its predetermined threshold value, the processing unit 12 causes an output signal to be sent to the network 28 which in turn pages or otherwise summons the retailer's personnel in order to assist the customer. In addition, if the suspicion log exceeds its predetermined threshold value, the processing unit 12 causes an output signal to be sent to the network 28 which in turn pages or otherwise summons the retailer's personnel such as security personnel to audit or otherwise investigate the customer's transaction. If neither the event log nor the suspicion log exceeds its respective threshold value, the routine 256 then advances to the re-scan subroutine 314.

As discussed above, during execution of subroutine 314 (see FIG. 12), the processing unit 12 communicates with the video system 16 thereby monitoring the customer's return of the unscanned item to the area proximate the scanner 14 in order for the item to be subsequently re-scanned. No further discussion of the subroutine 314 is warranted.

Returning now to step 368, if the unscanned item is not moved across the target area associated with the post-scan area 27, the routine 256 advances to step 378. Step 378 follows the same procedure outlined above in regard to step 282. In particular, the processing unit 12 determines if the unscanned item is placed in the post-scan area 27. More specifically, the light curtain device 24 generates an output or detection signal which is sent to the processing unit 12 once the light curtain 25 has been interrupted by the customer placing the unscanned item in the post-scan area 27. If the unscanned item is placed in the post-scan area 27, an invalid-use control signal is generated and the routine 256 advances to step 410. If the unscanned item is not placed in the post-scan area 27, the routine advances to step 412.

In step 410, the processing unit 12 causes a message to be displayed on the display monitor 18 which instructs the customer to remove the item from the post-scan area 27, and thereafter re-scan the item. The routine 256 then advances to step 414.

In step 414, the processing unit 12 increments the event log and the suspicion log by a predetermined value. More specifically, the processing unit 12 generates an output signal which is sent to the memory device 30 which causes the event log and the suspicion log to be incremented in the memory device 30 by a value of one.

Thereafter, the processing unit 12 determines if the total value of either the event log or the suspicion log exceeds the respective predetermined threshold value for each log. More specifically, if the event log exceeds its predetermined threshold value, the processing unit 12 causes an output signal to be sent to the network 28 which in turn pages or otherwise summons the retailer's personnel in order to assist the customer. In addition, if the suspicion log exceeds its predetermined threshold value, the processing unit 12 causes an output signal to be sent to the network 28 which in turn pages or otherwise summons the retailer's personnel such as security personnel to audit or otherwise investigate the customer's transaction. If neither the event log nor the suspicion log exceeds its respective threshold value, the routine 256 then advances to the re-scan subroutine 388.

As discussed above, during execution of subroutine 388 (see FIG. 14), the processing unit 12 communicates with the video system 16 and the light curtain device 24 thereby monitoring the customer's removal of the item from the post-scan area 27 and thereafter return of the unscanned item to the area proximate the scanner 14 in order for the item to be subsequently re-scanned. Moreover, the subroutine 338 identifies the event as a beta-type event. No further discussion of the subroutine 388 is warranted.

Returning now to step 378, if the light curtain 25 is not interrupted, the routine 256 advances to step 412. In step 412, since (1) the video system 16 did not generate an output signal on the data communication line 42 indicating that a scanning motion was detected in the target area of the scanner 14, (2) the video system 16 did not generate an output signal on the data communication line 42 indicating that an item was placed on the product scale 22, (3) the scanner 14 did not generate an output signal on the data communication line 40 indicating an item was scanned, (4) the video system 16 did not generate an output signal on the data communication line 42 indicating that motion was detected in the post-scan area 27, and (5) the light curtain device 24 did not generate an output signal on the data communication line 50 indicating an item was placed in the post-scan area 27, the processing unit 12 concludes that there is no present attempt being made by a customer to scan or otherwise checkout an item. Thus, the routine 256 advances to step 262 to loop through the routine 256 once again.

While the invention has been illustrated and described in detail in the drawings and foregoing description, such an illustration and description is to be considered as exemplary and not restrictive in character, it being understood that only the preferred embodiments have been shown and described and that all changes and modifications that come within the spirit of the invention are desired to be protected.

Although the light curtain device 24 has herein been described as being positioned such that it may monitor the insertion and removal of items from both the post-scan set-aside surface 19*b* and the bagwell 15, and has significant advantages in the present invention by being so positioned, many of the advantages of the present invention may also be achieved by positioning the light curtain device 24 in an alternate location.

For example, the emitter array 24*a* and a corresponding receiver array 24*b* of the light curtain device 24 may be respectively positioned on adjacent posts 15*a* of the bagwell 15 such that a light curtain is defined which monitors the insertion and removal of items from the grocery bags 17, but not the post-scan set-aside surface 19*b*.

Moreover, although the bagwell 15 has herein been described as being configured such that items are advanced downwardly from the top of the bagwell 15 and into the grocery bags 17 after having been entered into the self-service checkout terminal 10, it should be appreciated that the bagwell 15 may be configured such that items are advanced into the bagwell 15 from other directions. For example, the bagwell 15 may be configured such that items are advanced into the grocery bags 17 from the front side of the bagwell 15 (versus the top of the bagwell 15). It should also be appreciated that if the bagwell is so configured, the light curtain device 24 would likewise be alternatively configured such that the light curtain 25 covered the front side entrance to the bagwell 15.

What is claimed is:

1. A method of providing security to a self-service checkout terminal, comprising the steps of:

generating an item-entered control signal when a product code associated with an item is entered into the terminal;

detecting insertion of the item into a grocery container with a light curtain device and generating a first detection control signal in response thereto; generating an invalid-use control signal when the first detection control signal is generated prior to generation of the item-entered control signal; and generating a valid-use control signal when the item-entered control signal is generated prior to generation of the first detection control signal.

2. The method of claim 1, wherein:

the self-service checkout terminal includes a bagwell for holding the grocery container, the bagwell defining an opening through which the item may be advanced, the light curtain device generates a light curtain positioned to cover the opening of the bagwell, and the light curtain device generates the first detection control signal when the item is advanced through the light curtain and into the bagwell.

3. The method of claim 2, wherein the detecting step includes the step of advancing the item through the light curtain and into the bagwell and generating the first detection control signal in response thereto.

4. The method of claim 1, further comprising the step of generating a message which instructs a user to remove the item from the grocery container in response to generation of the invalid-use control signal.

5. The method of claim 1, further comprising the step of:

entering a record corresponding to the item in a transaction table in response to generation of the valid-use control signal.

6. The method of claim 1, further comprising the step of detecting removal of the item from the grocery container with the light curtain device and generating a removal control signal in response thereto.

7. A method of providing security to a self-service checkout terminal, comprising the steps of:

generating an item-entered control signal when a product code associated with an item is entered into the terminal;

detecting insertion of the item into a grocery container with a light curtain device and generating a first detection control signal in response thereto: and generating an invalid-use control signal when the first detection control signal is generated prior to generation of the item-entered control signal, wherein the self-service checkout terminal includes a post-scan counter, further comprising the step of:

detecting placement of the item onto the post-scan counter with the light curtain device and generating a second detection control signal in response thereto.

8. The method of claim 7, wherein the light curtain device generates a light curtain which is positioned over the post-scan counter, further comprising the steps of:

advancing the item through the light curtain and onto the post-scan counter and generating the second detection control signal in response thereto.

9. A method of providing security to a self-service checkout terminal, comprising the steps of:

generating an item-entered control signal when a product code associated with an item is entered into the terminal;

detecting insertion of the item into a grocery container with a light curtain device and generating a first detection control signal in response thereto:

generating an invalid-use control signal when the first detection control signal is generated prior to generation of the item-entered control signal;

detecting removal of the item from the grocery container with the light curtain device and generating a removal control signal in response thereto:

detecting a first feature set of the item with a video system prior to insertion of the item into the grocery container;

detecting a second feature set of the item with the video system in response to generation of the removal control signal; and comparing the first feature set with the second feature set and generating a mismatch control signal if the first feature set does not match the second feature set.

10. The method of claim 9, further comprising the step of generating a message which instructs a user that an incorrect item was removed from the grocery container in response to generation of the mismatch control signal.

11. The method of claim 10, further comprising the steps of:

generating a match control signal if the first feature set matches the second feature set; and generating a message which instructs the user to re-enter the item in response to generation of the match control signal.

12. A self-service checkout terminal, comprising:

a bagwell for holding a grocery container, said bagwell defining an opening through which an item may be advanced:

a light curtain device which (1) generates a light curtain positioned to cover said opening of said bagwell, and (2) generates a first detection control signal when said item is advanced through said light curtain and into said bagwell;

a scanner;

a post-scan counter positioned downstream of said scanner; and a pre-scan counter positioned upstream of said scanner, wherein said light curtain is further positioned to cover said post-scan counter, and wherein said light curtain device generates a second detection control signal when said item is advanced through said light curtain and onto said post-scan counter.

13. The terminal of claim 12, wherein said light curtain device detects removal of said item from said bagwell and generates a removal control signal in response thereto, further comprising:

a video system for detecting (1) a first feature set of said item prior to insertion of said item into said bagwell, and (2) a second feature set of said item in response to generation of said removal control signal; and means for comparing said first feature set with said second feature set and generating a mismatch control signal if said first feature set does not match said second feature set.

14. The terminal of claim 13, further comprising:

means for generating a message which instructs a user that an incorrect item was removed from said grocery container in response to generation of said mismatch control signal.

15. The terminal of claim 13, further comprising:

means for generating a match control signal if said first feature set matches said second feature set; and means for generating a message which instructs a user to re-enter said item in response to generation of said match control signal.

16. A method of providing security to a self-service checkout terminal having a bagwell and a light curtain device that generates a light curtain which is positioned over the bagwell, comprising the steps of:

locating a grocery container in the bagwell;

generating an item-entered control signal when a product code associated with an item is entered into the terminal;

advancing the item through the light curtain and into the grocery container and generating a first detection control signal in response thereto;

generating an invalid-use control signal when the first detection control signal is generated prior to generation of the item-entered control signal; and generating a valid-use control signal when the item-entered control signal is generated prior to generation of the first detection control signal.

17. The method of claim 16, further comprising the step of generating a message which instructs a user to remove the item from the grocery container in response to generation of the invalid-use control signal.

18. The method of claim 16, further comprising the step of:

entering a record corresponding to the item in a transaction table in response to generation of the valid-use control signal.

19. The method of claim 16, further comprising the step of advancing the item from the grocery container and through the light curtain and generating a removal control signal in response thereto.

20. A method of providing security to a self-service checkout terminal having a bagwell and a light curtain device that generates a light curtain which is positioned over the bagwell, comprising the steps of:

locating a grocery container in the bagwell;

generating an item-entered control signal when a product code associated with an item is entered into the terminal;

advancing the item through the light curtain and into the grocery container and generating a first detection control signal in response thereto; and generating an invalid-use control signal when the first detection control signal is generated prior to generation of the item-entered control signal, wherein (1) the self-service checkout terminal includes a post-scan counter, and (2) the light curtain is further positioned over the post-scan counter, further comprising the step of:

advancing the item through the light curtain and onto the post-scan counter and generating a second detection control signal in response thereto.

21. A method of providing security to a self-service checkout terminal having a bagwell and a light curtain device that generates a light curtain which is positioned over the bagwell, comprising the steps of:

locating a grocery container in the bagwell;

generating an item-entered control signal when a product code associated with an item is entered into the terminal;

advancing the item through the light curtain and into the grocery container and generating a first detection control signal in response thereto;

generating an invalid-use control signal when the first detection control signal is generated prior to generation of the item-entered control signal;

advancing the item from the grocery container and through the light curtain and generating a removal control signal in response thereto;

detecting a first feature set of the item with a video system prior to insertion of the item into the grocery container;

detecting a second feature set of the item with the video system in response to generation of the removal control signal; and comparing the first feature set with the second feature set and generating a mismatch control signal if the first feature set does not match the second feature set.

22. The method of claim 21, further comprising the step of generating a message which instructs a user that an incorrect item was removed from the grocery container in response to generation of the mismatch control signal.

23. The method of claim 22, further comprising the steps of:

generating a match control signal if the first feature set matches the second feature set; and generating a message which instructs the user to re-enter the item in response to generation of the match control signal.

* * * * *